US009778599B2

(12) United States Patent
Miyakoshi

(10) Patent No.: US 9,778,599 B2
(45) Date of Patent: Oct. 3, 2017

(54) INTERMEDIATE TRANSFER UNIT THAT REDUCES DAMAGE OF INTERMEDIATE TRANSFER BELT PLACED ON FLOOR, AND IMAGE FORMING APPARATUS INCLUDING THE SAME

(71) Applicant: KYOCERA Document Solutions Inc., Osaka (JP)

(72) Inventor: Naoto Miyakoshi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/276,459

(22) Filed: Sep. 26, 2016

(65) Prior Publication Data

US 2017/0090352 A1 Mar. 30, 2017

(30) Foreign Application Priority Data

Sep. 30, 2015 (JP) ..... 2015-193567

(51) Int. Cl.
*G03G 15/16* (2006.01)
*G03G 21/16* (2006.01)

(52) U.S. Cl.
CPC ..... *G03G 15/161* (2013.01); *G03G 21/168* (2013.01)

(58) Field of Classification Search
CPC ..... G03G 15/1605; G03G 15/161; G03G 21/168; G03G 21/1846; G03G 2221/1642
USPC ..... 399/121, 110, 111
See application file for complete search history.

(56) References Cited

U.S. PATENT DOCUMENTS 6,571,073 B1 * 5/2003 Suzuki ..... G03G 21/1619 399/121 X
2007/0041744 A1 * 2/2007 Gumbe ..... G03G 21/1828 399/111
2011/0064467 A1 * 3/2011 Hayakawa ..... G03G 15/1665 399/121
2011/0311274 A1 * 12/2011 Ishii ..... G03G 21/1853 399/113
2012/0308243 A1 * 12/2012 Kawasumi ..... G03G 21/1619 399/13
2014/0010575 A1 * 1/2014 Sakuma ..... G03G 21/168 399/121

FOREIGN PATENT DOCUMENTS

JP 2003-043764 A 2/2003

* cited by examiner

*Primary Examiner* — Sophia S Chen
(74) *Attorney, Agent, or Firm* — Stein IP, LLC

(57) ABSTRACT

An intermediate transfer unit includes an intermediate transfer belt, a plurality of transfer rollers, a pair of sidewalls, and a plurality of leg portions. The plurality of the leg portions abut on a predetermined installation surface when the intermediate transfer unit is detached from an apparatus main body. At least three of the leg portions are located at a lower end portion of the pair of the sidewalls. At least one sidewall of the pair of the sidewalls includes a shaft portion protruding in a first direction. At least one leg portion among the plurality of the leg portions is a movable leg turnable about the shaft portion. The movable leg has a changeable posture between a first posture and a second posture. The first posture supports the intermediate transfer unit detached from the apparatus main body. The second posture is turned about the shaft portion from the first posture.

8 Claims, 19 Drawing Sheets

INTERMEDIATE TRANSFER UNIT THAT REDUCES DAMAGE OF INTERMEDIATE TRANSFER BELT PLACED ON FLOOR, AND IMAGE FORMING APPARATUS INCLUDING THE SAME

INCORPORATION BY REFERENCE

This application is based upon, and claims the benefit of priority from, corresponding Japanese Patent Application No. 2015-193567 filed in the Japan Patent Office on Sep. 30, 2015, the entire contents of which are incorporated herein by reference.

BACKGROUND

Unless otherwise indicated herein, the description in this section is not prior art to the claims in this application and is not admitted to be prior art by inclusion in this section.

As a typical image forming apparatus employing an electrophotographic method, an image forming apparatus, such as a printer and a copier, there has been known an image forming apparatus that includes a photoreceptor drum and an intermediate transfer unit. The photoreceptor drum carries an electrostatic latent image. The intermediate transfer unit transfers a toner image onto a sheet from this photoreceptor drum. The intermediate transfer unit includes an intermediate transfer belt and a primary transfer roller to transfer an image with a plurality of colors, which is typically a full-color image, to the sheet. The intermediate transfer belt is opposed to and is wound around a plurality of the photoreceptor drums. A primary transfer voltage applied to the primary transfer roller transfers the toner image on the intermediate transfer belt from respective photoreceptor drums.

There is proposed a technique where respective drum units supporting intermediate transfer unit and photoreceptor drum are removably attachable to an apparatus main body of an image forming apparatus. Additionally, there is proposed an interference preventing member that prevents interference between an intermediate transfer belt and a drum unit when the drum units are mounted and removed.

SUMMARY

An intermediate transfer unit according to one aspect of the disclosure is mounted into an apparatus main body including a plurality of photoreceptor drums. The plurality of the photoreceptor drums are rotationally driven about axes extending in a first direction. The plurality of the photoreceptor drums are located adjacent to one another at predetermined intervals in a second direction intersecting with the first direction. The intermediate transfer unit is mounted adjacent to the plurality of the photoreceptor drums along the second direction. The intermediate transfer unit includes an intermediate transfer belt, a plurality of transfer rollers, a pair of sidewalls, and a plurality of leg portions. The intermediate transfer belt is circularly driven along the second direction. The intermediate transfer belt has a surface that carries toner images transferred from the plurality of the photoreceptor drums. The plurality of the transfer rollers are located opposed to the respective photoreceptor drums across the intermediate transfer belt. The pair of the sidewalls is located extending in the second direction at both end sides of the first direction. The pair of the sidewalls supports the intermediate transfer belt to be able to circulate. The plurality of the leg portions abut on a predetermined installation surface when the intermediate transfer unit is detached from the apparatus main body. At least three of the leg portions are located at a lower end portion of the pair of the sidewalls. At least one sidewall of the pair of the sidewalls includes a shaft portion protruding in the first direction. At least one leg portion among the plurality of the leg portions is a movable leg turnable about the shaft portion. The movable leg has a changeable posture between a first posture and a second posture. The first posture is for supporting the intermediate transfer unit detached from the apparatus main body. The second posture is turned about the shaft portion from the first posture.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
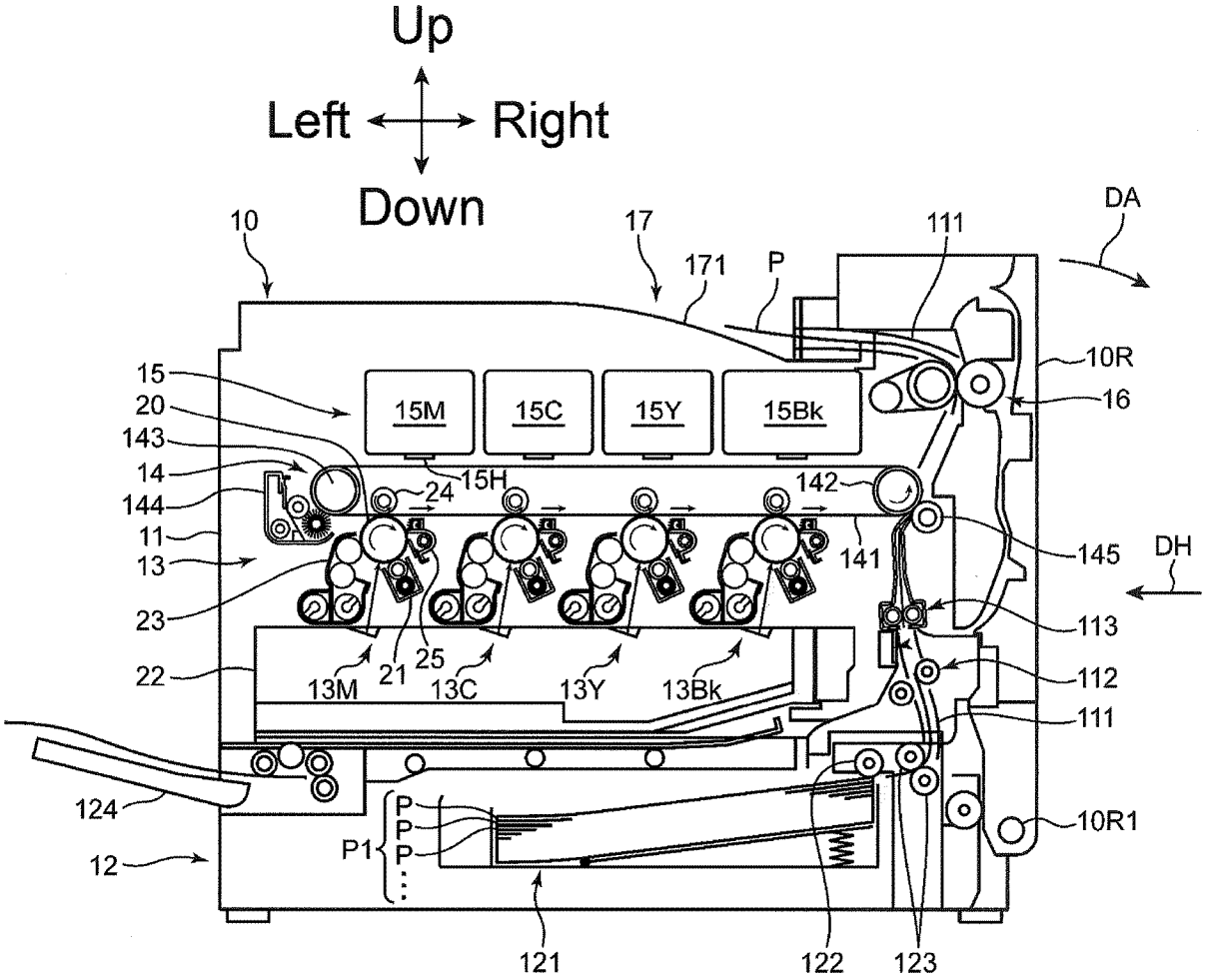
FIG. 1 illustrates a cross section of an internal structure of an image forming apparatus according to embodiments of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes an image forming apparatus 10 according to embodiments of the disclosure in detail on the basis of the accompanying drawings. This embodiment exemplifies a tandem type color printer as an exemplary image forming apparatus. The image forming apparatus may be devices such as a copier, a facsimile device, and a multi-functional peripheral of these devices.

FIG. 1 illustrates a cross section of an internal structure of the image forming apparatus 10. The image forming apparatus 10 includes an apparatus main body 11 having a box-shaped chassis structure. The apparatus main body 11 internally includes a paper sheet feeder 12, an image forming unit 13, an intermediate transfer unit 14, a secondary transfer roller 145, a toner replenishment unit 15, and a fixing unit 16. The paper sheet feeder 12 feeds a sheet P. The image forming unit 13 forms a toner image, which is to be transferred on the sheet P fed from the paper sheet feeder 12. The toner image is primarily transferred on the intermediate transfer unit 14. The toner replenishment unit 15 replenishes the image forming unit 13 with toner. The fixing unit 16 performs a process for fixing an unfixed toner image formed on the sheet P on the sheet P. Furthermore, on an upper portion of the apparatus main body 11, a paper sheet discharge unit 17 is located. The sheet P on which a fixing process is performed by the fixing unit 16 is discharged to the paper sheet discharge unit 17.

The apparatus main body 11 internally includes a sheet conveyance path 111 extending in a vertical direction. The sheet conveyance path 111 is located at a right side position with respect to the image forming unit 13. The sheet conveyance path 111 includes a conveyance roller pair 112, which conveys a sheet to an appropriate position, and a registration roller pair 113. The sheet conveyance path 111 is a conveyance path that conveys the sheet P from the paper sheet feeder 12 to the paper sheet discharge unit 17 via the image forming unit 13 (a secondary transfer nip portion) and the fixing unit 16.

The paper sheet feeder 12 includes a sheet feed tray 121, a pickup roller 122, a feed roller pair 123, and a bypass tray 124. The sheet feed tray 121 stores a sheet bundle P1, which are a plurality of piled sheets P.

The image forming apparatus 10 further includes a right cover unit 10R (see FIG. 1). The right cover unit 10R defines a side portion at the right side of the apparatus main body 11. The right cover unit 10R includes a cover fulcrum 10R1. The right cover unit 10R is releasable in an arrow-DA direction about the cover fulcrum 10R1 from the apparatus main body 11. The right cover unit 10R rotatably supports, for example, the secondary transfer roller 145 and a right-side roller of the registration roller pair 113. Then, when the right cover unit 10R is released, the sheet conveyance path 111 is exposed to the outside of the apparatus main body 11. This state ensures the intermediate transfer unit 14 mounted in the apparatus main body 11.

The image forming unit 13 forms a toner image to be transferred to the sheet P. The image forming unit 13 includes a plurality of image forming units, which form toner images of different colors. As these image forming units, this embodiment includes a magenta unit 13M, which uses a magenta (M) color developer, a cyan unit 13C, which uses a cyan (C) color developer, a yellow unit 13Y, which uses a yellow (Y) color developer, and a black unit 13Bk, which uses a black (Bk) color developer, located sequentially from upstream to downstream in a rotation direction of an intermediate transfer belt 141 (from the left side to the right side shown in FIG. 1). The units 13M, 13C, 13Y, and 13Bk each include a photoreceptor drum 20 (an image carrier), a charging apparatus 21, which is arranged at a peripheral area of the photoreceptor drum 20, a developing device 23, and a cleaning apparatus 25. An exposure apparatus 22 shared by the respective units 13M, 13C, 13Y, and 13Bk is arranged below the image forming unit.

The photoreceptor drum 20 is rotatably driven about the axis, and an electrostatic latent image and a toner image are formed on a circumference surface of the photoreceptor drum 20. A rotation shaft of the photoreceptor drum 20 extends in a front-rear direction (a first direction, that is, the direction perpendicular to the paper surface of FIG. 1). As this photoreceptor drum 20, a photoreceptor drum using an amorphous silicon (a-Si)-based material is applicable. As illustrated in FIG. 1, a plurality of the photoreceptor drums 20 corresponding to the respective colors are arranged at predetermined intervals in a second direction intersecting with the first direction (a lateral direction, that is, a horizontal direction).

The charging apparatus 21 uniformly charges the surface of the photoreceptor drum 20. The exposure apparatus 22 irradiates the circumference surface of the uniformly-charged photoreceptor drum 20 with a light modulated on the basis of image data to form the electrostatic latent image. The cleaning apparatus 25 cleans the circumference surface of the photoreceptor drum 20 after the toner image transfer.

The developing device 23 supplies the surface of the photoreceptor drum 20 with the toner. The developing device 23 is for a two-component developer constituted of a toner and a carrier. The toner of the developing device 23 is supplied to the surface of the photoreceptor drum 20, thus developing the electrostatic latent image. In the embodiments, the toner has a property that positively charges the toner.

The intermediate transfer unit 14 is located at a space between the image forming unit 13 and the toner replenishment unit 15. The intermediate transfer unit 14 includes the intermediate transfer belt 141, a drive roller 142, a tension roller 143, a plurality of primary transfer rollers 24 (transfer rollers), and a belt cleaning apparatus 144.

The intermediate transfer belt 141 is an endless belt-shaped rotator and is suspended across the drive roller 142 and the tension roller 143 such that its circumference surface side abuts on the circumference surfaces of the respective photoreceptor drums 20. The intermediate transfer belt 141 is circularly driven in one direction along the second direction, and carries the toner image transferred from the plurality of the photoreceptor drums 20 on its surface. The intermediate transfer belt 141 is a conductive soft belt with a laminated structure constituted of a base layer, an elastic layer, and a coat layer.

The drive roller 142 stretches the intermediate transfer belt 141 at a right end side of the intermediate transfer unit 14, and causes the intermediate transfer belt 141 to be circularly driven. The drive roller 142 is constituted of a metal roller. The tension roller 143 stretches the intermediate transfer belt 141 at a left end side of the intermediate transfer unit 14. The tension roller 143 provides the intermediate transfer belt 141 with a tensile strength. The belt cleaning apparatus 144 (see FIG. 1), which is located at the proximity of the tension roller 143, removes a remnant toner on a circumference surface of the intermediate transfer belt 141.

The primary transfer rollers 24 are located opposed to the photoreceptor drum 20 across the intermediate transfer belt 141. This forms primary transfer nip portions between the primary transfer rollers 24 and the photoreceptor drums 20 to primarily transfer the toner images, which are on the photoreceptor drum 20, on the intermediate transfer belt 141. As illustrated in FIG. 1, the respective primary transfer rollers 24 are located opposed to the photoreceptor drums 20 for the respective colors. The primary transfer rollers 24 are rollers extending in the front-rear direction, and are rotationally driven along with the intermediate transfer belt 141.

The secondary transfer roller 145 is located opposed to the drive roller 142 across the intermediate transfer belt 141. The secondary transfer roller 145 is pressed and abuts on the circumference surface of the intermediate transfer belt 141 to form a secondary transfer nip portion. The toner image primarily transferred on the intermediate transfer belt 141 is secondarily transferred on the sheet P supplied from the paper sheet feeder 12 at the secondary transfer nip portion.

The toner replenishment unit 15 stores toners used for image formation. The toner replenishment unit 15 according to the embodiment includes a magenta toner container 15M, a cyan toner container 15C, a yellow toner container 15Y, and a black toner container 15Bk. These toner containers 15M, 15C, 15Y, and 15Bk store respective replenishment toners for the respective colors M, C, Y, and Bk. The toner containers 15M, 15C, 15Y, and 15Bk replenish the toners for the respective colors to the developing devices 23 for the image forming units 13M, 13C, 13Y, and 13Bk, which correspond to the respective colors M, C, Y, and Bk, from toner discharge ports 15H, which are formed on the bottom surfaces of the containers, via a toner conveying unit (not illustrated).

The fixing unit 16 fixes the toner image transferred on the sheet P.

The paper sheet discharge unit 17 is formed by depressing the top of the apparatus main body 11. The bottom portion of this depressed portion includes a sheet discharge tray 171 that receives the discharged sheet P. The sheet P on which the fixing process has been performed is discharged to the sheet discharge tray 171 via the sheet conveyance path 111 running from an upper portion of the fixing unit 16.

Figure 2A:
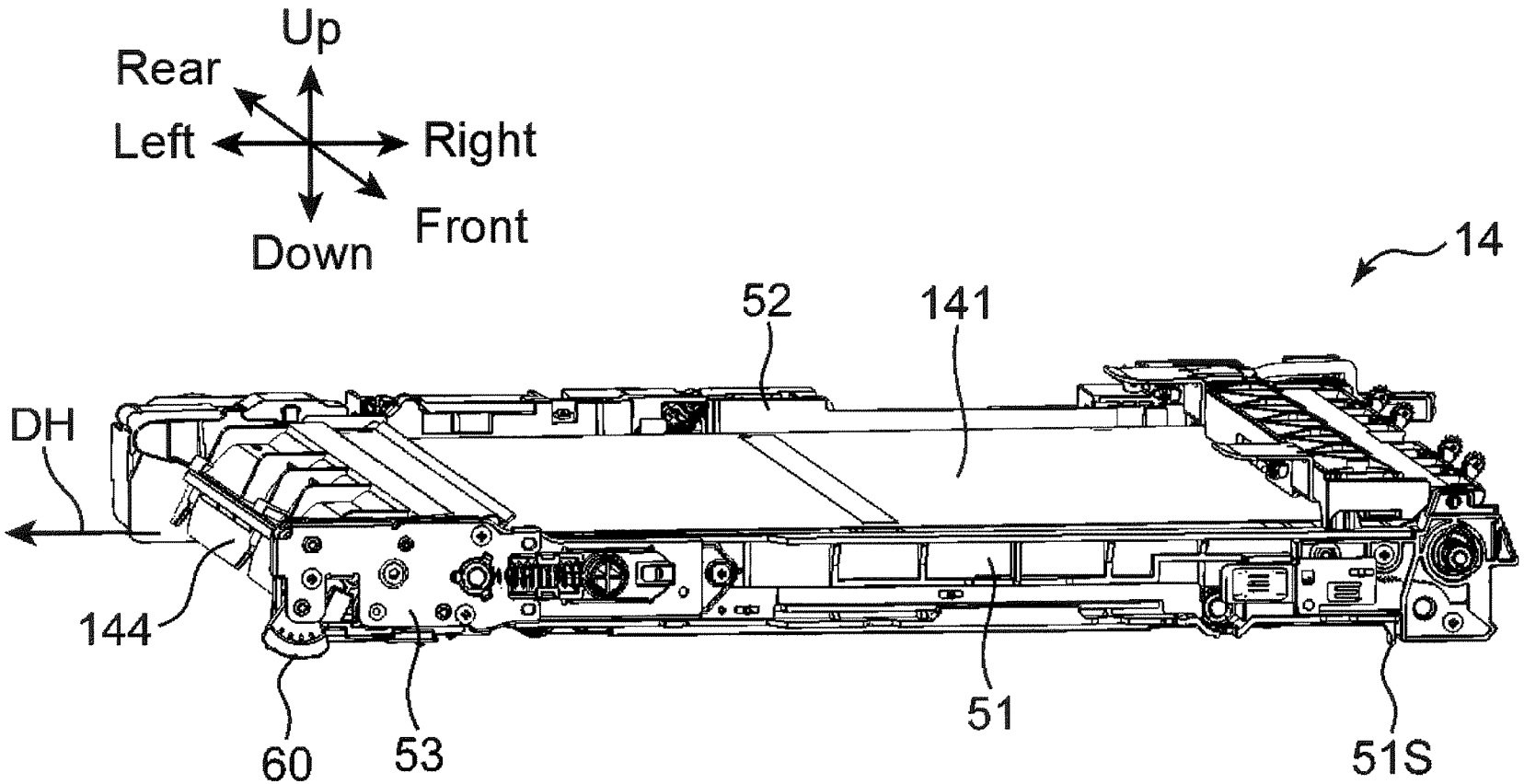
FIG. 2A obliquely illustrates an intermediate transfer unit according to a first embodiment.
Figure 2B:
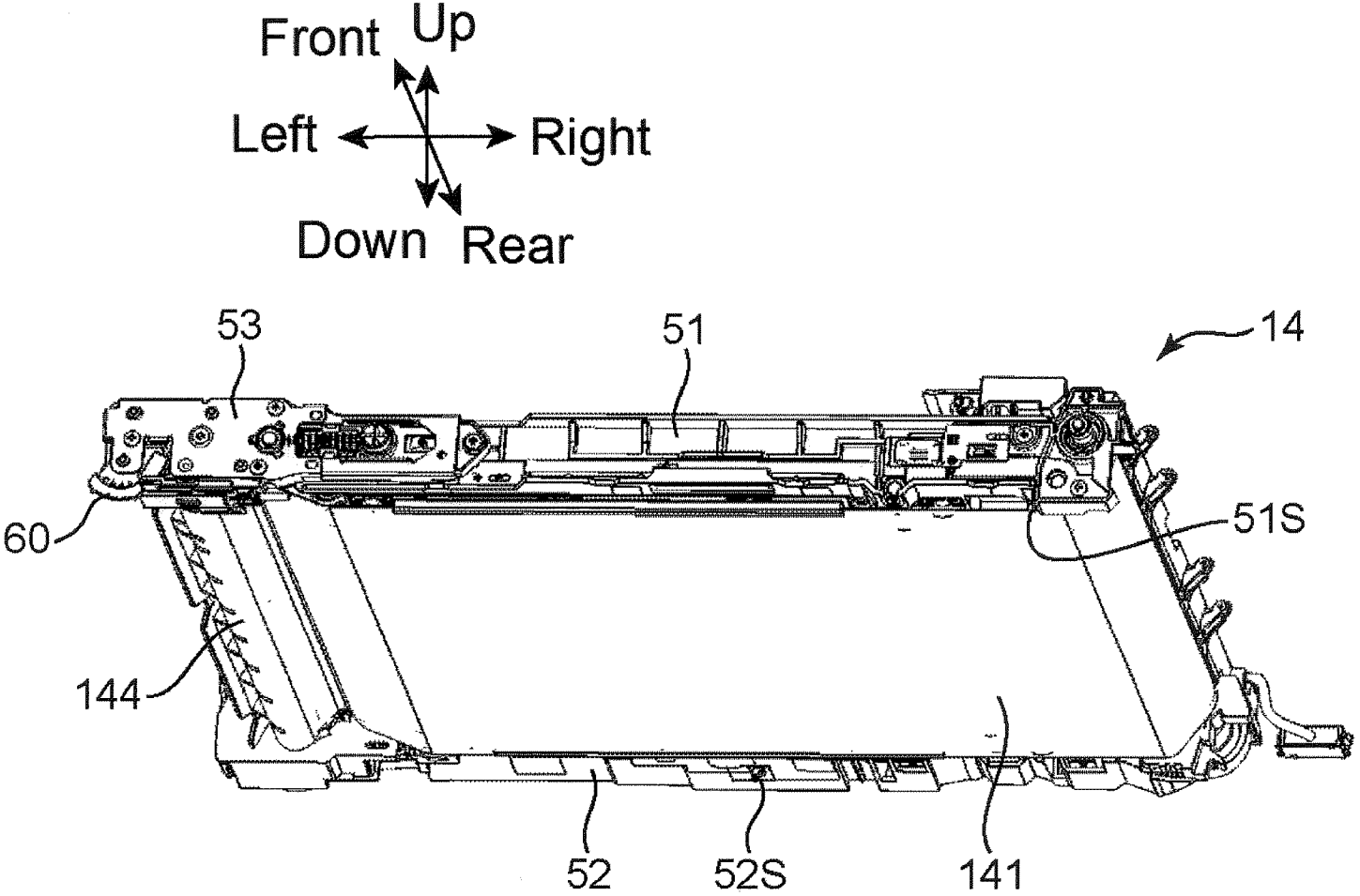
FIG. 2B obliquely illustrates the intermediate transfer unit according to the first embodiment.
Figure 3A:
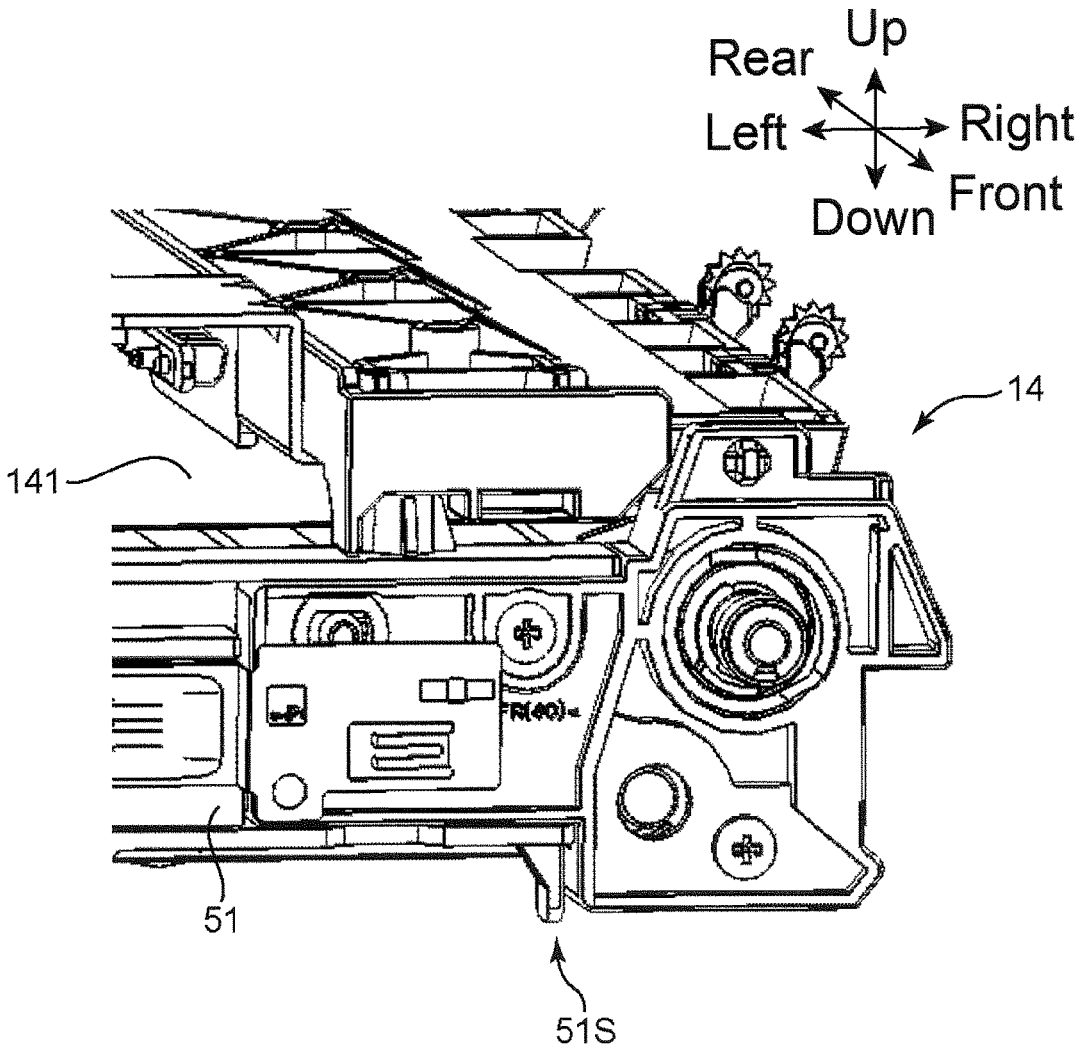
FIG. 3A obliquely illustrates an enlarged part of the intermediate transfer unit according to the first embodiment.
Figure 3B:
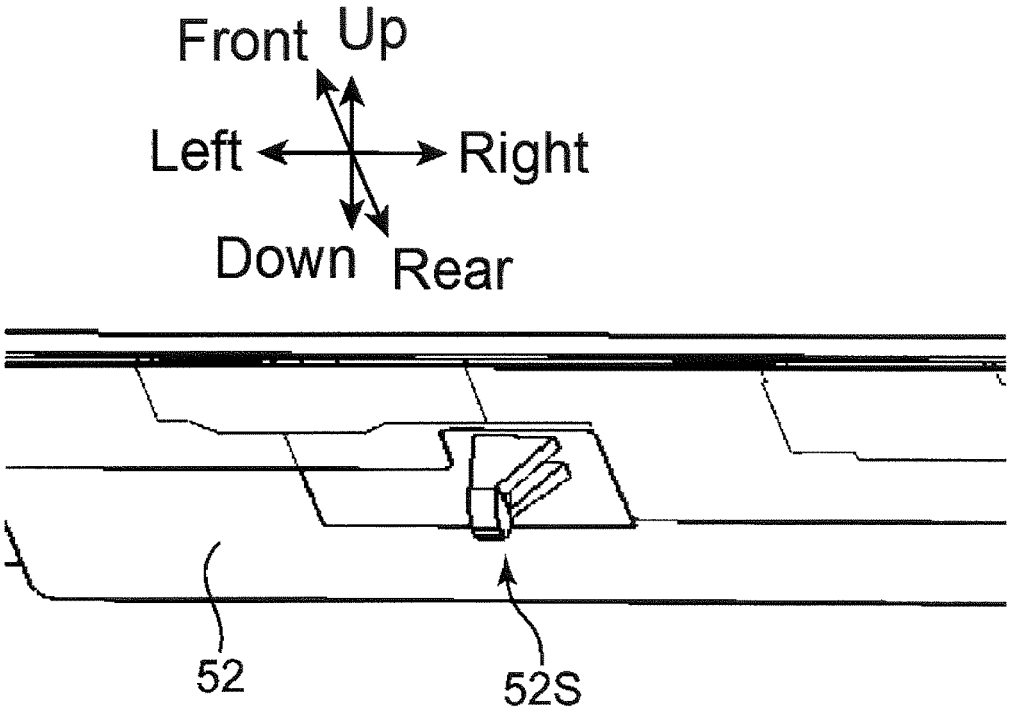
FIG. 3B obliquely illustrates an enlarged part of the intermediate transfer unit according to the first embodiment.

Subsequently, in addition to FIG. 1, with reference to FIGS. 2A to 4, the following describes the intermediate transfer unit 14 according to a first embodiment of the disclosure in detail. FIGS. 2A and 2B obliquely illustrate the intermediate transfer unit 14 according to the first embodiment. FIGS. 3A and 3B obliquely illustrate an enlarged part of the intermediate transfer unit 14 according to the first embodiment. Similarly, FIG. 4, obliquely illustrates an enlarged part of the intermediate transfer unit 14 according to the first embodiment.

The intermediate transfer unit 14 is a unit having a low profile rectangular parallelepiped shape extending in a front-rear direction and a lateral direction. As illustrated in FIG. 2A, the intermediate transfer unit 14 extends long in the lateral direction. The intermediate transfer unit 14 includes a unit front wall 51 (a sidewall) and a unit rear wall 52 (a sidewall). The unit front wall 51 and the unit rear wall 52 are a pair of the sidewalls, and arranged such that the unit front wall 51 and the unit rear wall 52 are located at both the end sides of the front-rear direction and extend in the lateral direction. The unit front wall 51 and the unit rear wall 52 are frames made of a resin material. The unit front wall 51 and the unit rear wall 52 support the intermediate transfer belt 141 to be able to circulate. Specifically, the above-described drive roller 142, the tension roller 143, and the plurality of the primary transfer rollers 24 are rotatably supported at the unit front wall 51 and the unit rear wall 52. The unit front wall 51 and the unit rear wall 52 have left end sides supporting the above-described belt cleaning apparatus 144. After the right cover unit 10R is released from the apparatus main body 11, the intermediate transfer unit 14 is mounted in the apparatus main body 11 along the arrow-DH direction in FIGS. 1 and 2A. In this case, the intermediate transfer unit 14 is arranged so as to be adjacent to the photoreceptor drums 20 at upper sides of the plurality of the photoreceptor drums 20.

The intermediate transfer unit 14 further includes a front plate 53, a first fixed leg portion 51S (a leg portion), a second fixed leg portion 52S (a leg portion), and a movable leg 60 (leg portion). The front plate 53 is a sheet-metal member mounted at a left end side of the unit front wall 51 from a front. The front plate 53 is secured to the unit front wall 51 by a plurality of screws. The first fixed leg portion 51S, the second fixed leg portion 52S, and the movable leg 60 are leg portions located on lower end portions of the unit front wall 51 and the unit rear wall 52. When the intermediate transfer unit 14 is detached from the apparatus main body 11, these leg portions have a function to support the intermediate transfer unit 14 by abutting on a predetermined installation surface (a floor surface).

With reference to FIGS. 2A and 3A, the first fixed leg portion 51S protrudes downward from a lower portion of a right end side of the unit front wall 51. With reference to FIGS. 2B and 3B, the second fixed leg portion 52S protrudes downward from a lower portion of the center portion of the unit rear wall 52 in the lateral direction. Additionally, the movable leg 60 is located at a left end portion of the unit front wall 51.

Figure 4:
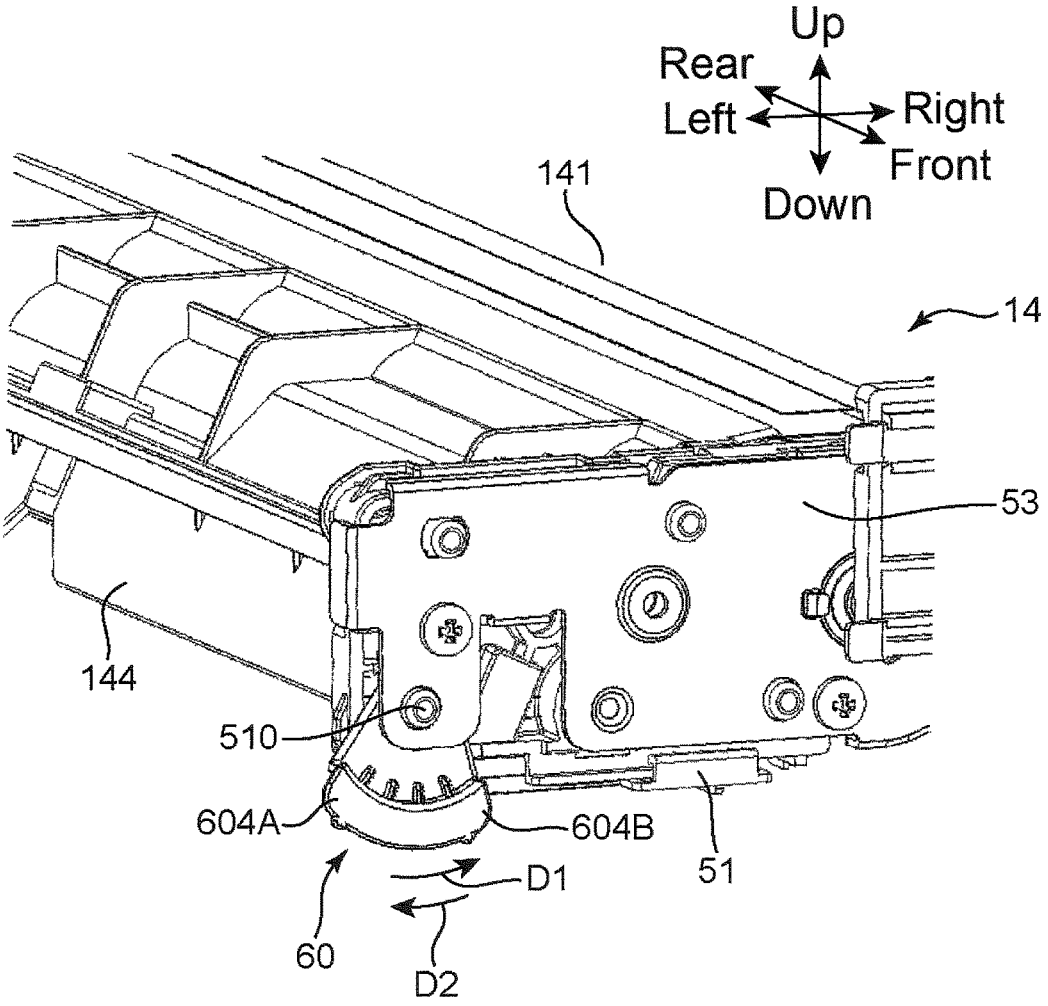
FIG. 4 obliquely illustrates an enlarged part of the intermediate transfer unit according to the first embodiment.
Figure 5:
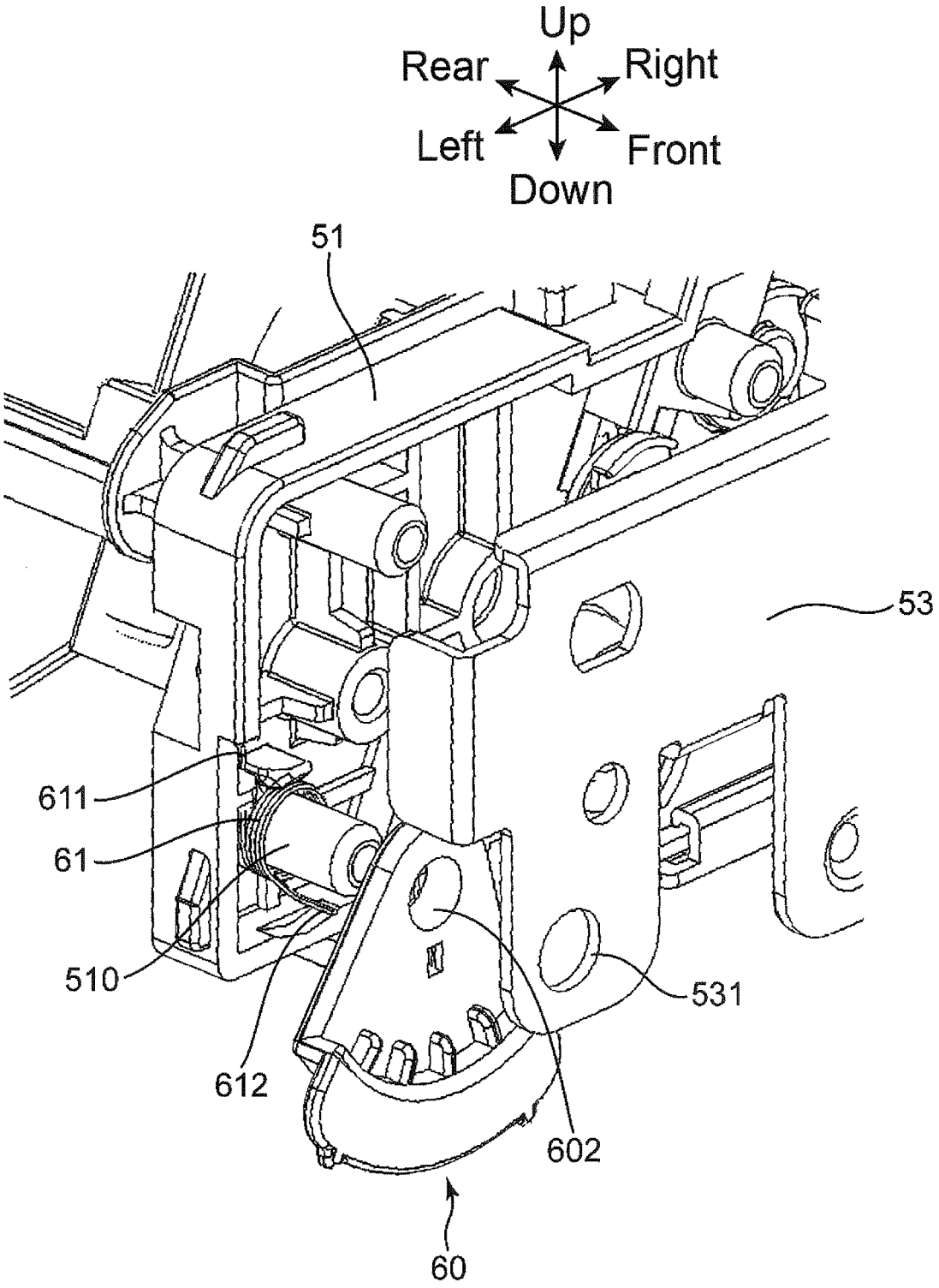
FIG. 5 illustrates an exploded perspective view of a part of the intermediate transfer unit according to the first embodiment.
Figure 6:
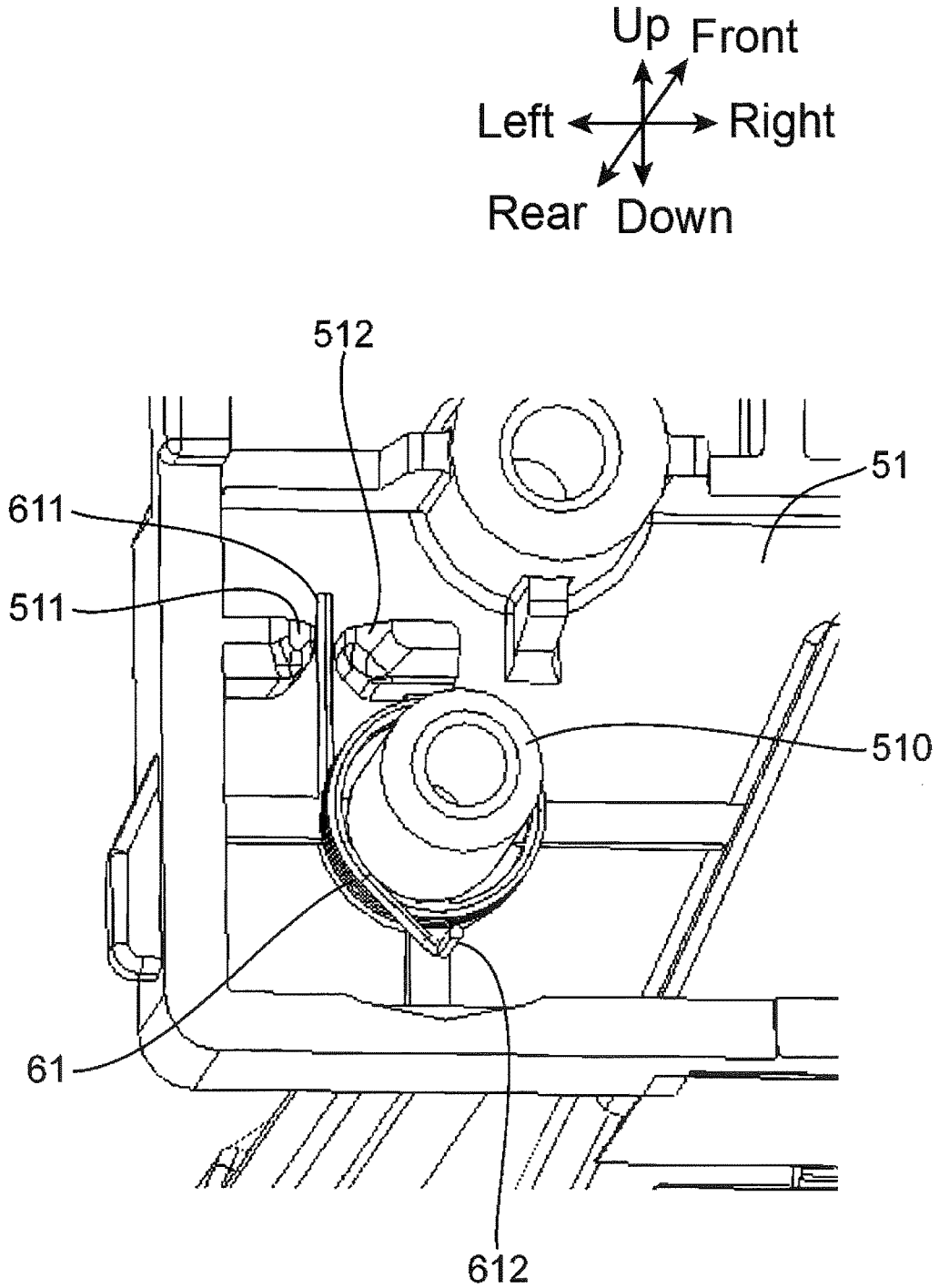
FIG. 6 obliquely illustrates a part of the intermediate transfer unit according to the first embodiment in a state where a movable leg is removed.
Figure 7:
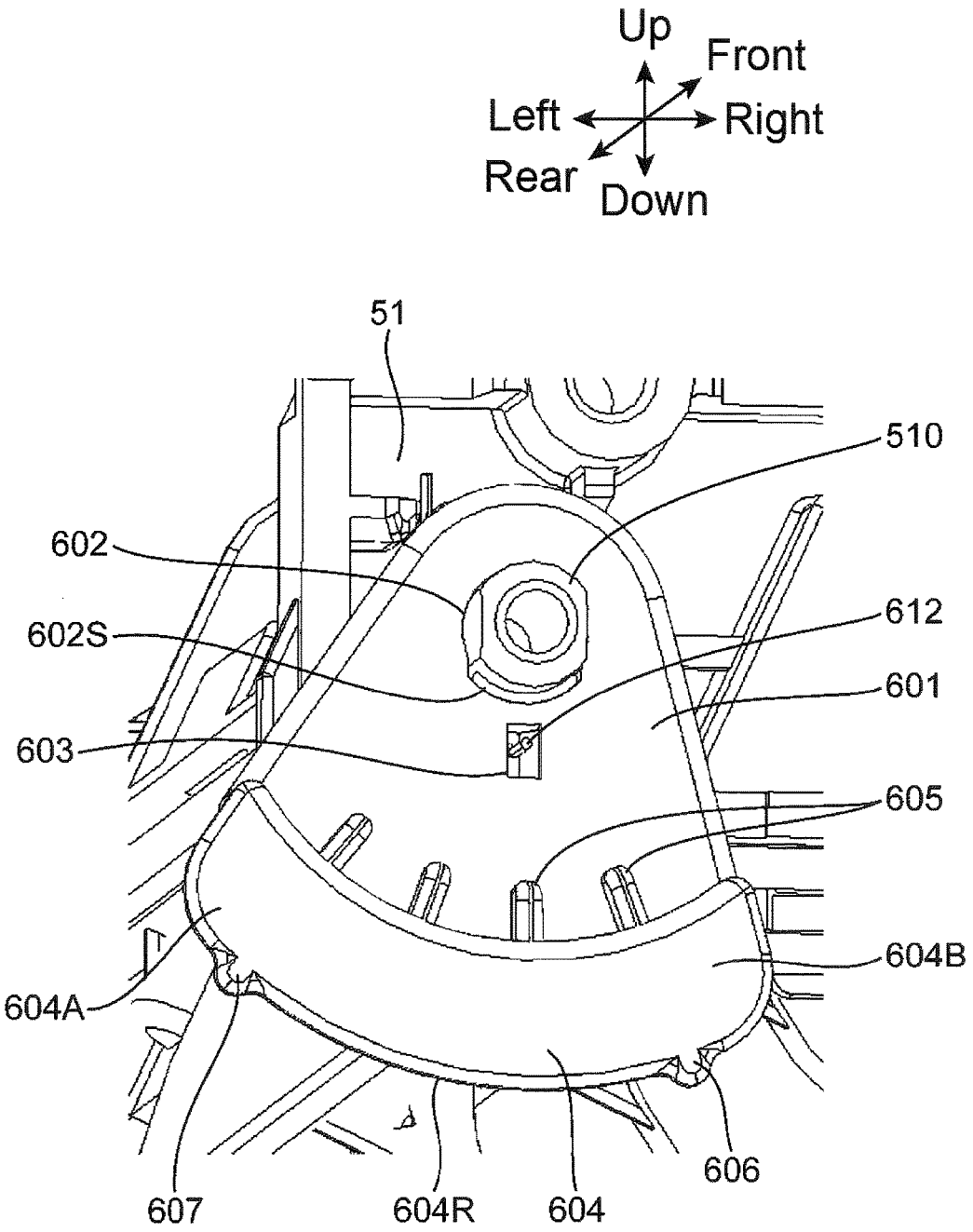
FIG. 7 obliquely illustrates a part of the intermediate transfer unit according to the first embodiment in a state where the movable leg is mounted.
Figure 8:
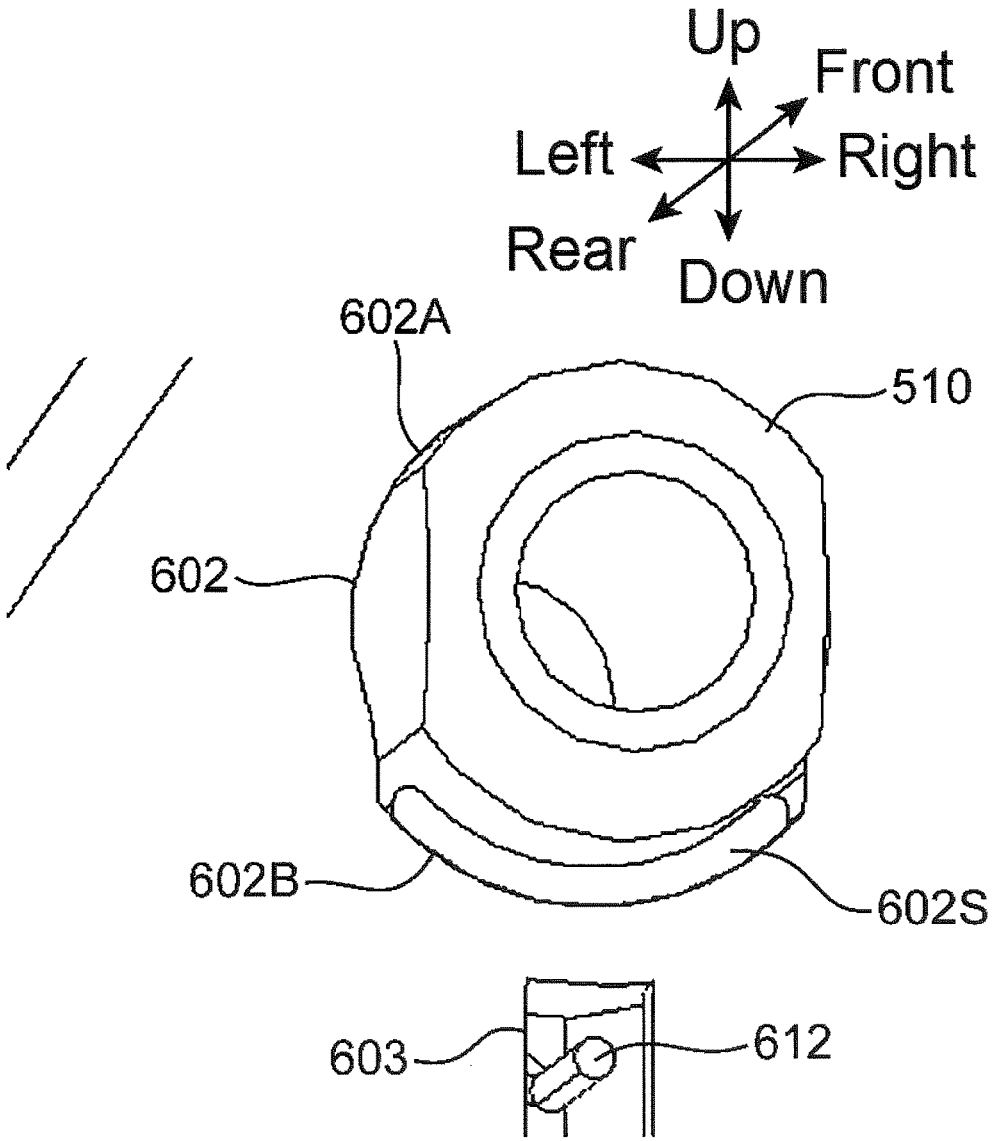
FIG. 8 obliquely illustrates an enlarged part of the movable leg according to the first embodiment.
Figure 9:
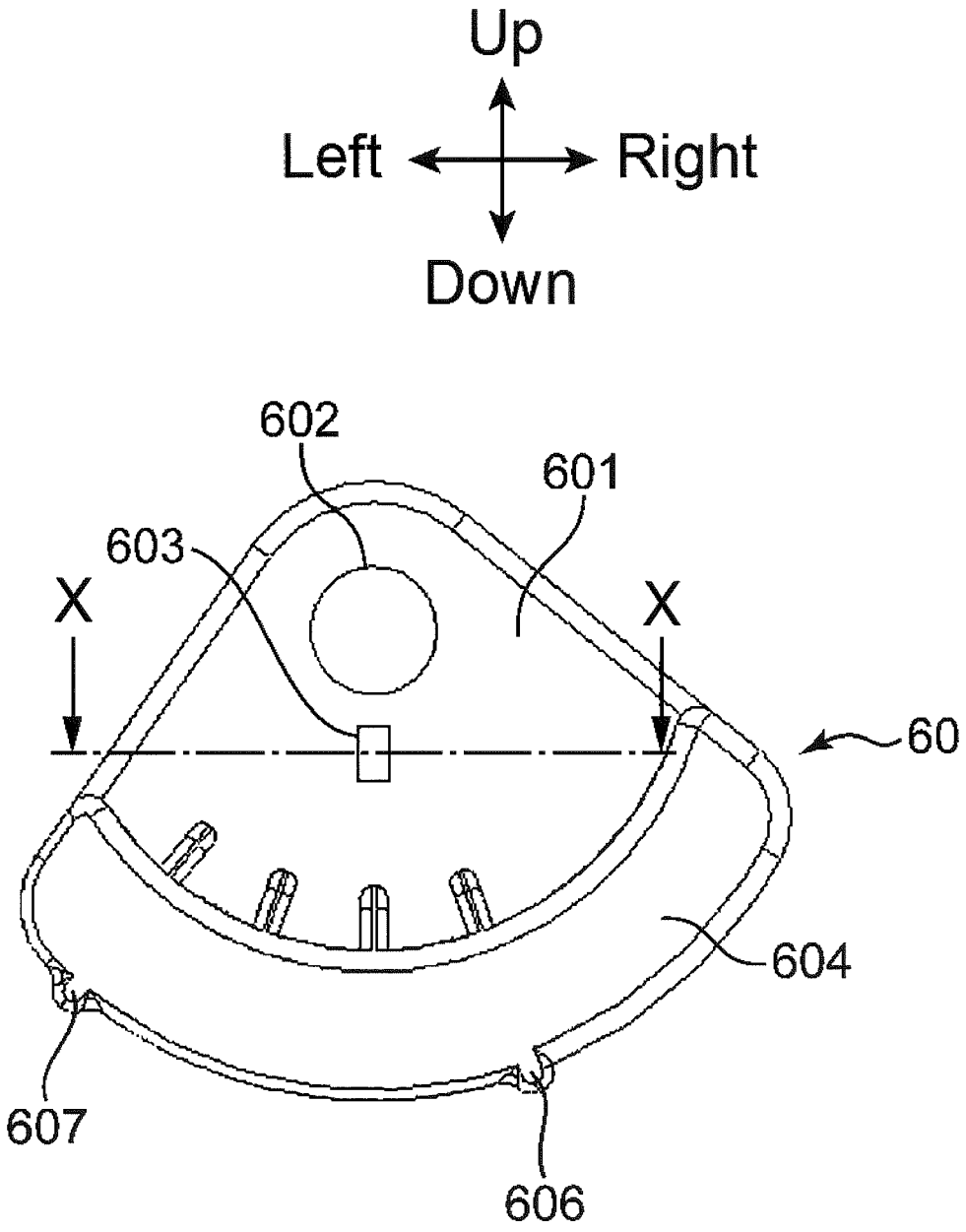
FIG. 9 illustrates a front of the movable leg according to the first embodiment.
Figure 10:
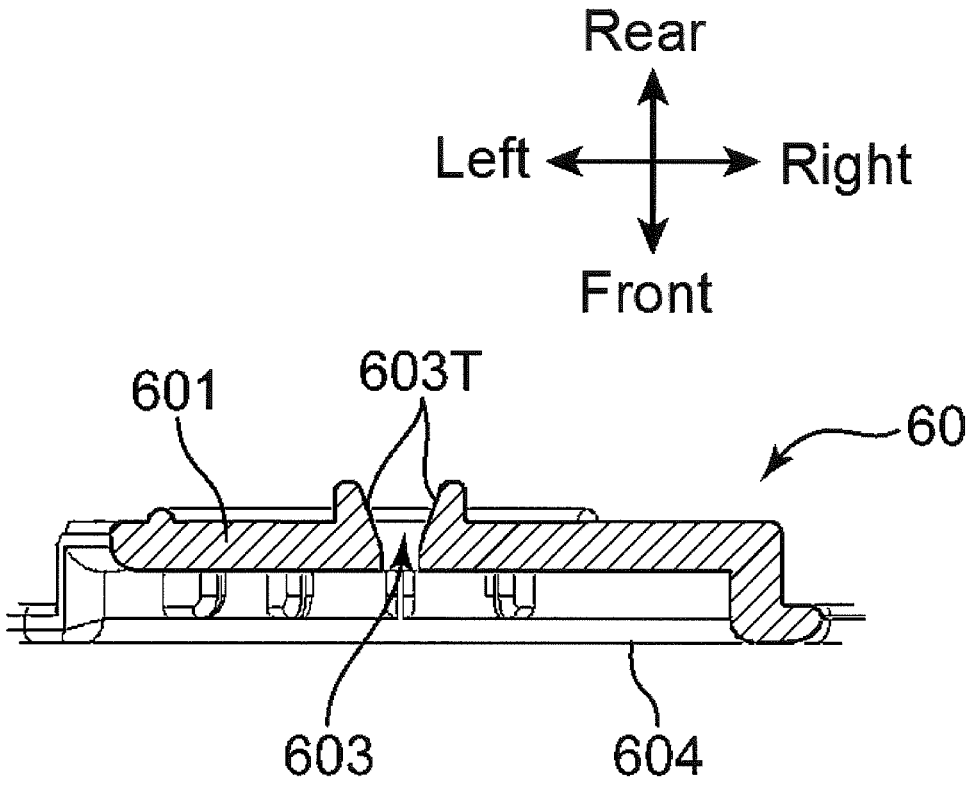
FIG. 10 illustrates a cross section of the movable leg according to the first embodiment.

FIG. 5 illustrates an exploded perspective view of a part of the intermediate transfer unit 14 illustrated in FIG. 4. FIG. 6 obliquely illustrates the intermediate transfer unit 14 illustrated in FIG. 4 in a state where the movable leg 60 is removed. FIG. 7 obliquely illustrates the intermediate transfer unit 14 illustrated in FIG. 6 in a state where the movable leg 60 is mounted. FIG. 8 obliquely illustrates an enlarged part of the movable leg 60 illustrated in FIG. 7. FIG. 9 illustrates a front of the movable leg 60 according to the first embodiment. FIG. 10 illustrates a cross section of the movable leg 60 taken along the line X-X illustrated in FIG. 9 in a horizontal direction.

With reference to FIGS. 5 and 6, the unit front wall 51 includes a shaft portion 510, a first engagement protrusion 511 (see FIG. 6), and a second engagement protrusion 512 (see FIG. 6). The shaft portion 510 is a cylindrically-shaped protrusion protruding toward a front (a first direction) from the left end portion of the unit front wall 51. The first engagement protrusion 511 and the second engagement protrusion 512 are approximately-rectangular-parallelepiped shaped protrusions protruding toward the front from the unit front wall 51 above the shaft portion 510. As illustrated in FIG. 6, a slight gap is formed between the first engagement protrusion 511 and the second engagement protrusion 512.

The movable leg 60 is turnable about the shaft portion 510. The movable leg 60 changes its own posture between a first posture and a second posture. The first posture is a posture that supports the intermediate transfer unit 14 detached from the apparatus main body 11 on the floor surface (an installation surface). The second posture is a posture that is turned about the shaft portion 510 from the first posture. In the first posture, a lower end portion of the movable leg 60 has a height identical to heights of lower end portions of the first fixed leg portion 51S and the second fixed leg portion 52S. Meanwhile in the second posture, the lower end portion of the movable leg 60 retreats above the lower end portions of the first fixed leg portion 51S and the second fixed leg portion 52S.

The movable leg 60 is made of a plate-shaped member arranged intersecting with the front-rear direction and opposed to the unit front wall 51. The movable leg 60 has an approximately-fan shape. The movable leg 60 includes a main unit 601, a hole portion 602, a lock hole 603, an outer peripheral portion 604, ribs 605, a first protrusion 606, and a second protrusion 607 (see FIG. 7).

The main unit 601 is a main unit part of the movable leg 60 having the approximately fan shape. The main unit 601 is turnable about the shaft portion 510. The main unit 601 has three corner portions located in an arc as illustrated in FIG. 7. The hole portion 602 is an approximately-circular shaped hole formed by passing through the main unit 601 of the movable leg 60 along the front-rear direction at an upper end side of the main unit 601. The above-described shaft portion 510 is inserted into the hole portion 602.

The lock hole 603 is a rectangular-shaped hole formed by passing through the main unit 601 of the movable leg 60 along the front-rear direction immediately below the hole portion 602. The lock hole 603 is opened smaller than the hole portion 602. With reference to FIG. 10, the lock hole 603 has a reverse taper shape (a reverse tapered portion 603T) reversely tapering toward the unit front wall 51 (rearward).

The outer peripheral portion 604 is a part of the main unit 601 and is located at a lower end portion of the movable leg 60. As illustrated in FIG. 7, the outer peripheral portion 604 has a circular arc shape, centered on the hole portion 602, having a predetermined width in a radial direction. The outer peripheral portion 604 is arranged so as to have a step with respect to an upper end portion of the main unit 601, and is located at the front with respect to the upper end portion of the main unit 601. The intermediate transfer unit 14 detached from the apparatus main body 11 ensures an outer peripheral edge 604R of the outer peripheral portion 604 to abut on the floor surface.

The ribs 605 are protrusions located on the main unit 601 so as to abut on the outer peripheral portion 604. The ribs 605 are arranged at intervals in a circumferential direction on the circular arc shape of the outer peripheral portion 604. A plurality of the ribs 605 provide a high rigidity of the movable leg 60. This reduces damage of the movable leg 60 even when the movable leg 60 supports the intermediate transfer unit 14.

The first protrusion 606 and the second protrusion 607 are a pair of protrusions protruding from the outer peripheral edge 604R at intervals in the circumferential direction. The first protrusion 606 and the second protrusion 607 are located across the lowest end portion of the outer peripheral edge 604R of the outer peripheral portion 604 at the first posture illustrated in FIG. 7.

The intermediate transfer unit 14 further includes a bias spring 61 (see FIGS. 5 and 6). The bias spring 61 is a twisted coil spring that biases the movable leg 60 about the shaft portion 510 to cause the movable leg 60 to have the first posture. The bias spring 61 is located between the movable leg 60 and the unit front wall 51, and is fitted onto the shaft portion 510. The bias spring 61 includes a first spring end portion 611 and a second spring end portion 612. The first spring end portion 611 is one end portion of the bias spring 61 made of a linear member. The first spring end portion 611 is locked between the first engagement protrusion 511 and the second engagement protrusion 512 of the unit front wall 51. The second spring end portion 612 is the other end portion of the bias spring 61. The second spring end portion 612 is locked in the lock hole 603 of the movable leg 60.

With reference to FIG. 8, the hole portion 602 includes an upper inner circumference surface 602A and a lower inner circumference surface 602B. The upper inner circumference surface 602A is an upper end portion of an inner circumference surface of the hole portion 602. As illustrated in FIG. 7, when the movable leg 60 becomes to have the first posture, the upper inner circumference surface 602A is opposed to an upper end side of the shaft portion 510. Similarly, the lower inner circumference surface 602B is a lower end portion of the inner circumference surface of the hole portion 602. The lower inner circumference surface 602B is formed by a slight extension of a lower end side of the approximately-circular-shaped hole portion 602 below. In this case, viewing from the center of the shaft portion 510 (the shaft center), the lower inner circumference surface 602B is located far with respect to the upper inner circumference surface 602A. As illustrated in FIGS. 7 and 8, when the movable leg 60 becomes to have the first posture, the lower inner circumference surface 602B is opposed to a lower end side of the shaft portion 510.

The intermediate transfer unit 14 further includes a slide member 602S (high-friction member) (see FIG. 8). The slide member 602S is a rubber member attached on the lower inner circumference surface 602B. When the movable leg 60 having the first posture abuts on the floor surface, the slide member 602S functions as a regulating mechanism that regulates the turn of the movable leg 60 about the shaft portion 510. In another embodiment, the slide member 602S may be secured to a lower end portion of a circumference surface of the shaft portion 510.

As illustrated in FIG. 6, the first spring end portion 611 of the bias spring 61 is lock between the first engagement protrusion 511 and the second engagement protrusion 512, and the bias spring 61 is fitted onto the shaft portion 510. Then, while the second spring end portion 612 is inserted into the lock hole 603 of the movable leg 60, the hole portion 602 is fitted onto the shaft portion 510 (see FIG. 7). In this case, since the lock hole 603 includes the reverse tapered portion 603T, the second spring end portion 612 is easily mounted at the lock hole 603. The shaft portion 510, which has passed through the hole portion 602, is inserted into a plate hole portion 531 opened on the front plate 53 (see FIG. 5). In this state, after the front plate 53 is fastened to the unit front wall 51, the movable leg 60 is turnably supported about the shaft portion 510.

The intermediate transfer unit 14 detached from the apparatus main body 11 ensures the intermediate transfer unit 14 directly placed on the floor surface (a predetermined installation surface). This improves maintainability of the detached intermediate transfer unit 14 and the apparatus main body 11 with an internal hollow. The intermediate transfer unit 14 includes at least three leg portions (the first fixed leg portion 51S, the second fixed leg portion 52S, and the movable leg 60). This reduces damage of the intermediate transfer belt 141 without having the intermediate transfer belt 141 abutting on the floor surface when the intermediate transfer belt 141 is placed directly.

As described above, the bias spring 61 biases the movable leg 60 such that the movable leg 60 has the first posture (see FIGS. 2A, 4, and 7). Thus, when the intermediate transfer unit 14 is detached from the apparatus main body 11, the movable leg 60 promptly becomes to have the first posture. This facilitates an achievement of the direct placement of the intermediate transfer unit 14.

As described above, the intermediate transfer unit 14 is located adjacent to the plurality of the photoreceptor drums 20. In the apparatus main body 11, the intermediate transfer belt 141 of the intermediate transfer unit 14 needs to abut on the photoreceptor drums 20. On the other hand, when the intermediate transfer unit 14 is detached from the apparatus main body 11, the movable leg 60 needs to project below the intermediate transfer belt 141 to protect the intermediate transfer belt 141. When the intermediate transfer unit 14 is mounted in the apparatus main body 11 in a state where the movable leg 60 projects below the intermediate transfer belt 141, the movable leg 60 may interfere with the photoreceptor drum 20 and another unit. In this case, this may cause an interference of mounting of the intermediate transfer unit 14, and may cause these units to be damaged one another.

In the embodiment, when the detached intermediate transfer unit 14 is mounted in the apparatus main body 11 again, the movable leg 60 becomes to be turnable about the shaft portion 510. This reduces, even when the intermediate transfer unit 14 is mounted adjacent to the photoreceptor drum 20 and another unit, the interference (a strong abutment) between the movable leg 60 and these units. In other words, when the movable leg 60 abuts on these units to be pressed, the movable leg 60 promptly changes its own posture into the second posture. This prevents these units from being damaged one another.

Especially, the movable leg 60 is turned toward a distal end side of the second direction (the arrow-D2 direction illustrated in FIG. 4) or a rear end side of the second direction (the arrow-D1 direction illustrated in FIG. 4) from the first posture about the shaft portion 510, so as to change its own posture into the second posture. That is, the movable leg 60 is turnable in either direction about the shaft portion 510. This reduces the interference between the movable leg 60 and another unit when the intermediate transfer unit 14 is mounted or detached.

When the intermediate transfer unit 14 is mounted in the apparatus main body 11, and then an outer-periphery left end portion 604A (see FIG. 4) of the movable leg 60 abuts on a drum unit (not illustrated) that supports the photoreceptor drum 20, the movable leg 60 turns in the arrow-D1 direction. After that, when the intermediate transfer unit 14 is mounted in the apparatus main body 11, the movable leg 60 is placeable at a predetermined space. This causes the movable leg 60 to change its own posture into the first posture again. On the other hand, when the intermediate transfer unit 14 is detached from the apparatus main body 11, and then an outer-periphery right end portion 604B (see FIG. 4) of the movable leg 60 abuts on the drum unit (not illustrated) that supports the photoreceptor drum 20, the movable leg 60 turns in the arrow-D2 direction. After that, when the intermediate transfer unit 14 is detached from the apparatus main body 11, the movable leg 60 changes its own posture into the first posture again. This ensures the intermediate transfer unit 14 to be placed on the floor.

The outer peripheral portion 604 of the movable leg 60 has the circular arc shape. This stably maintains distance between the intermediate transfer belt 141 and the floor surface even when the intermediate transfer unit 14 is placed on the floor and then the posture of the movable leg 60 changes. In the embodiment, the outer peripheral edge 604R includes the first protrusion 606 and the second protrusion 607 (see FIG. 7). Thus, even when a force of the horizontal direction is applied to the intermediate transfer unit 14, which is placed on the floor, the first protrusion 606 and the second protrusion 607 abut on the floor surface to regulate an excessive turn of the movable leg 60. This prevents the intermediate transfer unit 14 from falling down, thus reducing the damage of the intermediate transfer belt 141.

Additionally, in the embodiment, the slide member 602S functions as the regulating mechanism. That is, when the intermediate transfer unit 14 is placed on the floor outside the apparatus main body 11, its own weight of the intermediate transfer unit 14 causes the lower end portion of the shaft portion 510 to strongly abut on the slide member 602S. Thus, the friction between the shaft portion 510 and the inner circumference surface of the hole portion 602 increases. This regulates the turn of the movable leg 60. When the intermediate transfer unit 14 is lifted from the floor surface, its own weight of the movable leg 60 causes the upper end side of the shaft portion 510 to abut on the upper inner circumference surface 602A of the hole portion 602 (see FIG. 8). At this time, this forms a slight gap between the lower end side of the shaft portion 510 and the slide member 602S, thus facilitating the turn of the movable leg 60 in the apparatus main body 11.

Figure 11:
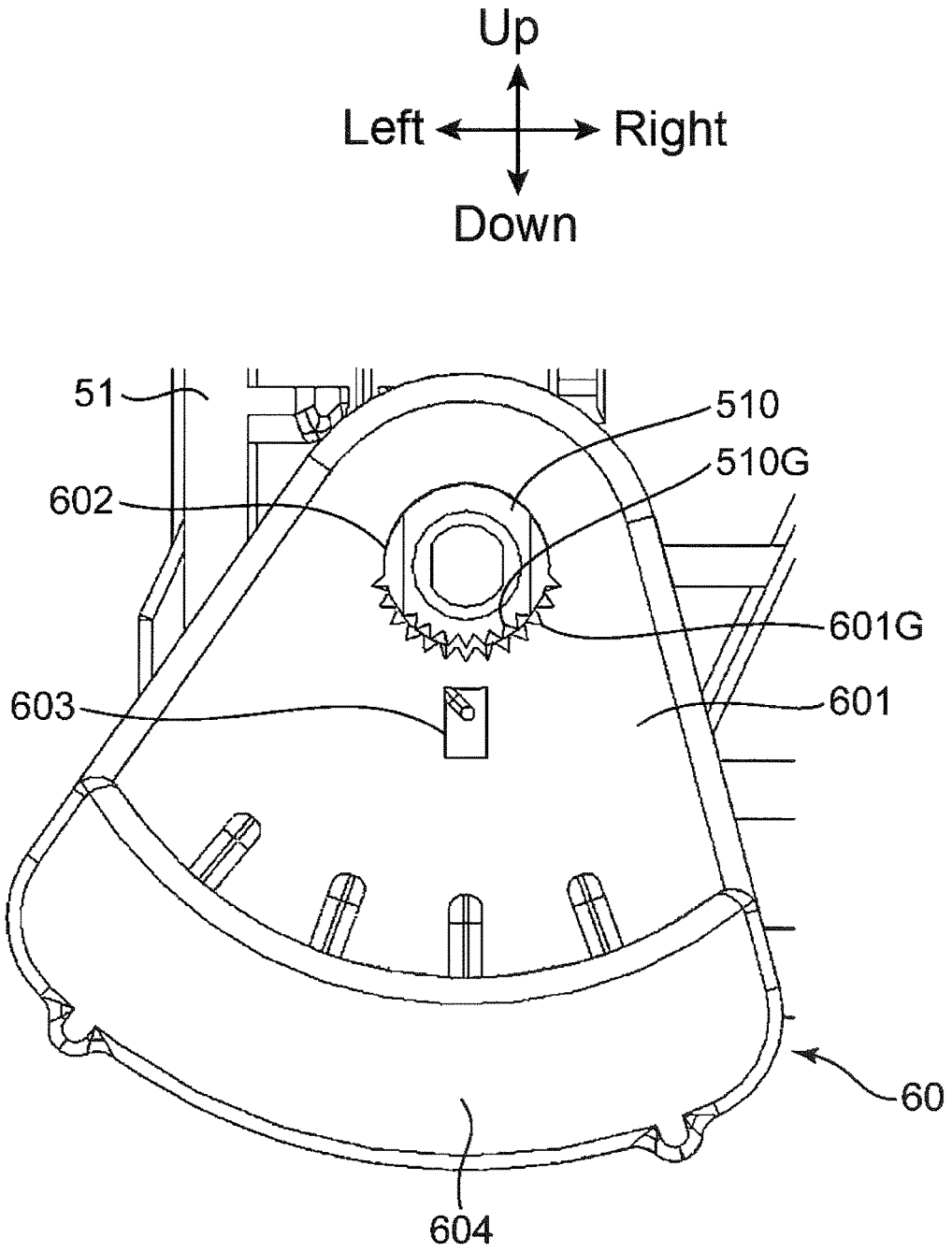
FIG. 11 illustrates a front of a periphery of the movable leg of the intermediate transfer unit according to a second embodiment of the disclosure.
Figure 12:
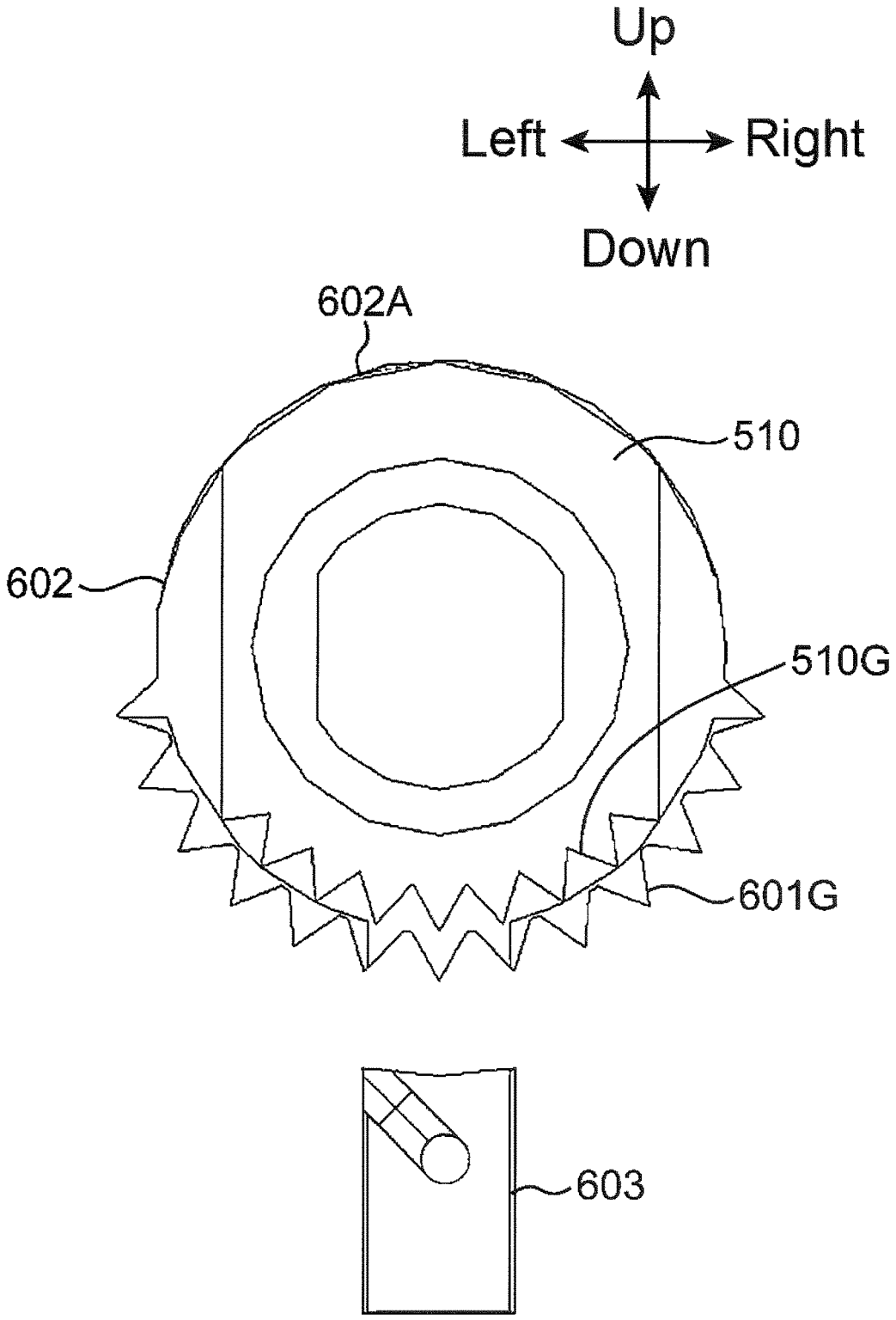
FIG. 12 illustrates a front of an enlarged part of the movable leg according to the second embodiment.

Next, the following describes the movable leg 60 according to a second embodiment of the disclosure. FIG. 11 illustrates a front of a periphery of the movable leg 60 of the intermediate transfer unit 14 according to the second embodiment. FIG. 12 illustrates a front of an enlarged part of the movable leg 60 illustrated in FIG. 11. The second embodiment is different from the above-described first embodiment in that the movable leg 60 includes first gear teeth 510G and second gear teeth 601G instead of the slide member 602S. Thus, the following mainly describes differences between the first and second embodiments and omits descriptions of common points.

With reference to FIGS. 11 and 12, the shaft portion 510 includes the first gear teeth 510G. The movable leg 60 includes the second gear teeth 601G. The first gear teeth 510G are a plurality of gear teeth located adjacent to the circumferential direction at the lower end side of the shaft portion 510. On the other hand, the second gear teeth 601G are located at the lower inner circumference surface 602B (see FIG. 8) of the hole portion 602. The second gear teeth 601G are a plurality of gear teeth engageable with the first gear teeth 510G. In the embodiment, the first gear teeth 510G and the second gear teeth 601G function as the regulating mechanism.

That is, when the intermediate transfer unit 14 is placed on the floor outside the apparatus main body 11, its own weight of the intermediate transfer unit 14 causes the first gear teeth 510G of the shaft portion 510 to mesh with the second gear teeth 601G of the movable leg 60. In this state, when a force of the horizontal direction is applied to the intermediate transfer unit 14, the engagement of the first gear teeth 510G with the second gear teeth 601G regulates the turn of the movable leg 60. Also in this case, when the intermediate transfer unit 14 is lifted from the floor surface, its own weight of the movable leg 60 causes the upper end side of the shaft portion 510 to abut on the upper inner circumference surface 602A of the hole portion 602 (see FIG. 12). At this time, this forms a slight gap between the first gear teeth 510G and the second gear teeth 601G of the shaft portion 510. This facilitates the turn of the movable leg 60 in the apparatus main body 11 without the engagement of the first gear teeth 510G with the second gear teeth 601G.

Figure 13:
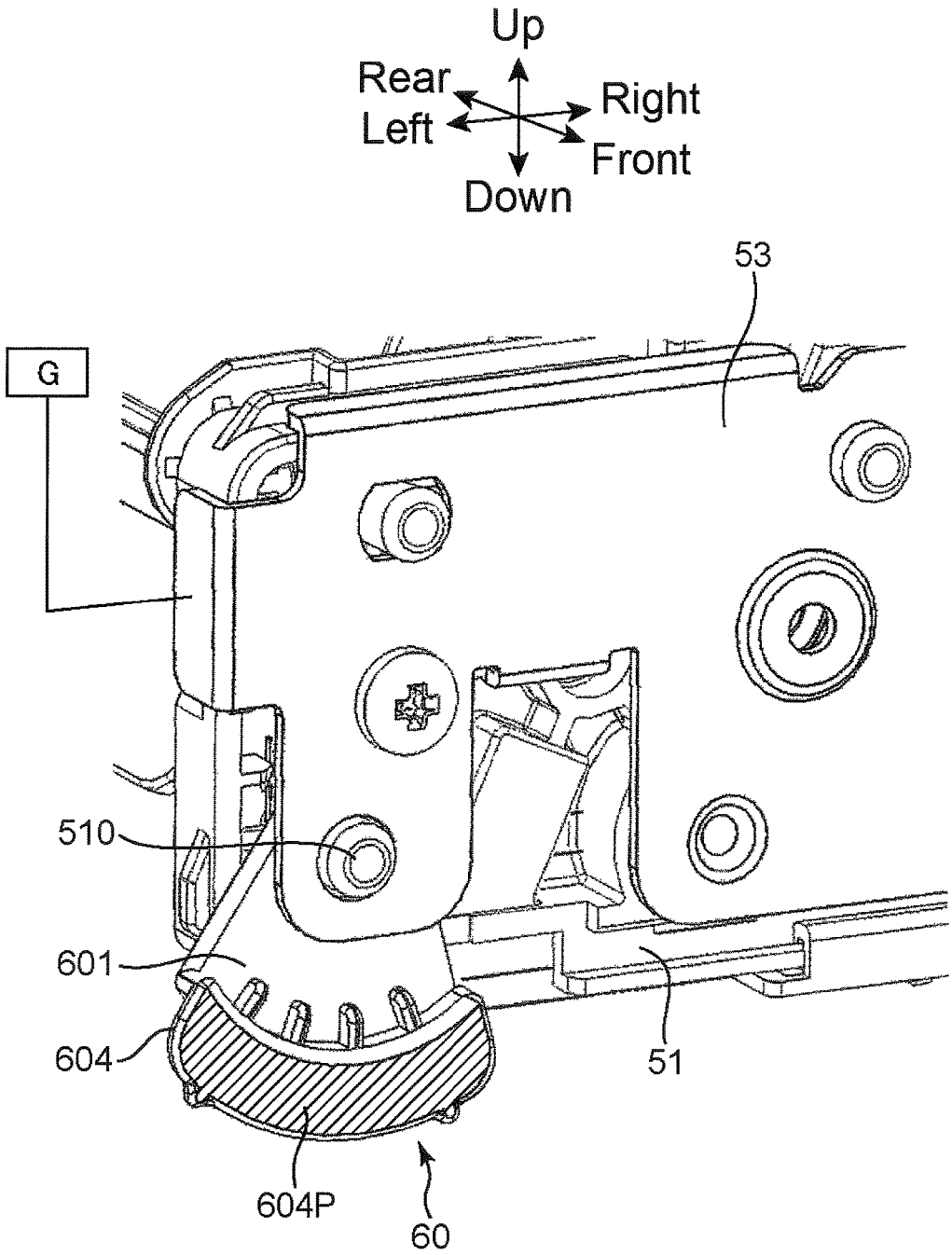
FIG. 13 obliquely illustrates a periphery of the movable leg of the intermediate transfer unit according to a third embodiment of the disclosure.
Figure 14:
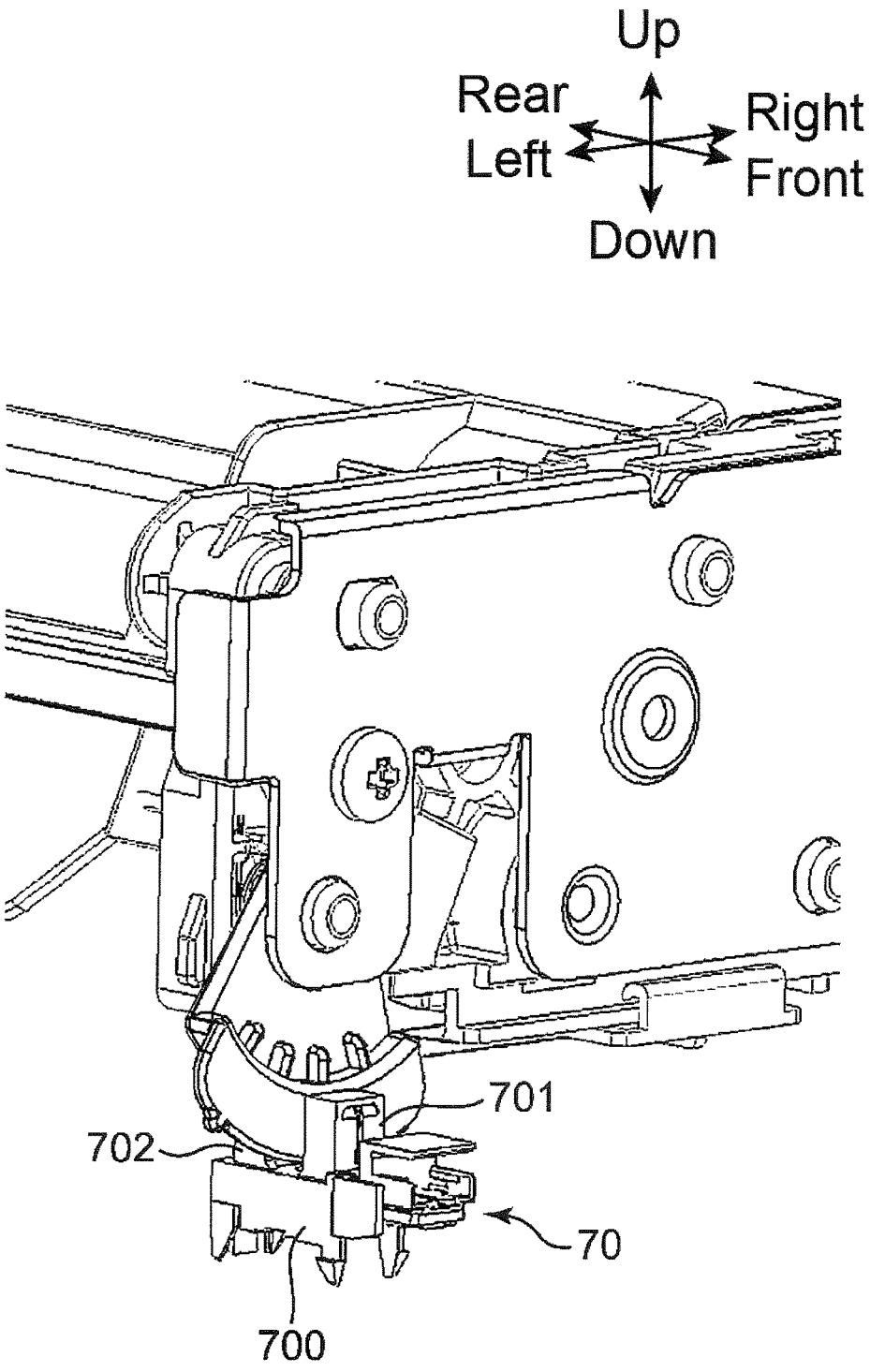
FIG. 14 obliquely illustrates the movable leg and a detection unit of the intermediate transfer unit according to the third embodiment.
Figure 15:
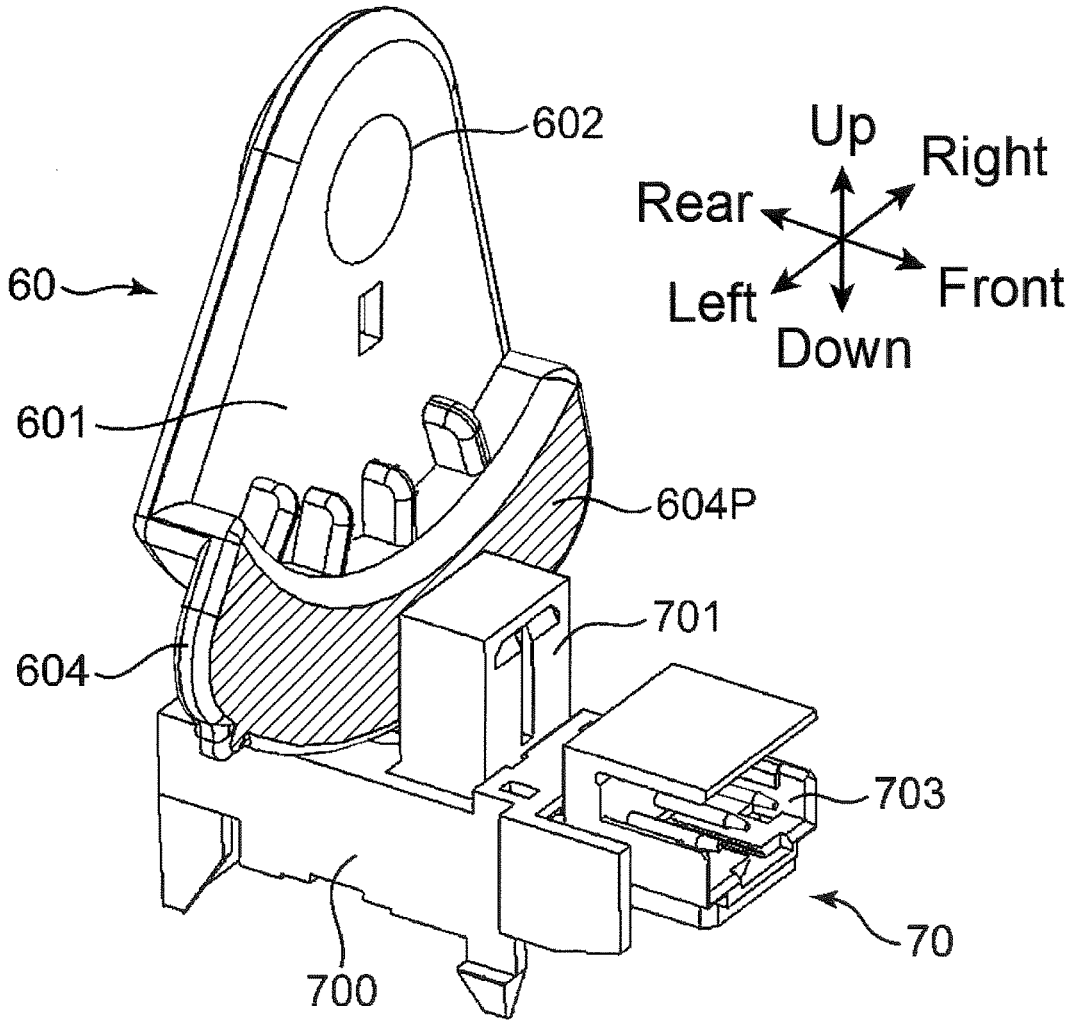
FIG. 15 obliquely illustrates the enlarged movable leg and the enlarged detection unit according to the third embodiment.

Subsequently, the following describes the movable leg 60 according to a third embodiment of the disclosure. FIG. 13 obliquely illustrates a periphery of the movable leg 60 of the intermediate transfer unit 14 according to the third embodiment of the disclosure. FIG. 14 obliquely illustrates the movable leg 60 and a unit-detection unit 70 (also referred to as a detection unit) of the intermediate transfer unit 14 according to the third embodiment. FIG. 15 obliquely illustrates the enlarged movable leg 60 and the enlarged unit-detection unit 70, which are illustrated in FIG. 14. The third embodiment is different from the above-described first embodiment in that the movable leg 60 includes a cleaning portion 604P (also referred to as a cleaning member), and the intermediate transfer unit 14 includes the unit-detection unit 70 and a driving mechanism G. Thus, the following mainly describes differences between the first and third embodiments and omits descriptions of common points.

In the embodiment, the movable leg 60 includes the cleaning portion 604P. The cleaning portion 604P is a sponge member located at a front side surface of the outer peripheral portion 604. In another embodiment, the cleaning portion 604P may be a brush member, or another member having a cleaning function.

The unit-detection unit 70 is a PI sensor (a photo sensor) included in the apparatus main body 11 of the image forming apparatus 10. The unit-detection unit 70 ensures detecting the movable leg 60 in the apparatus main body 11. The unit-detection unit 70 includes a unit main body 700, a light-emitting portion 701, a light receiving portion 702, and a connector portion 703. The light receiving portion 702 receives detection light emitted from the light-emitting portion 701. In this case, as illustrated in FIG. 15, when the outer peripheral portion 604 of the movable leg 60 is located between the light-emitting portion 701 and the light receiving portion 702, the detection light is blocked. This consequently causes a control unit (not illustrated) located in the apparatus main body 11 to detect a state of the intermediate transfer unit 14 in the apparatus main body 11. The connector portion 703 is electrically connected to the control unit via an electric board (not illustrated) included in the apparatus main body 11.

The driving mechanism G is included in the apparatus main body 11. The driving mechanism G includes a motor, a gear group connected to this motor, and a rotatable cam connected to this gear group, which are not illustrated. In the apparatus main body 11, the driving mechanism G vertically moves the primary transfer rollers 24 of the intermediate transfer unit 14. Specifically, the driving mechanism G changes a state of the intermediate transfer unit 14 into between a first state and a second state. When the intermediate transfer unit 14 is in the first state, the primary transfer rollers 24 for the respective colors abut on the photoreceptor drum 20 across the intermediate transfer belt 141. On the other hand, when the intermediate transfer unit 14 is in the second state, the primary transfer rollers 24 for the respective colors separate above from the photoreceptor drum 20. Then, the movable leg 60 is slidably and laterally moved between the first position and the second position in association with the state change of the intermediate transfer unit 14 by a slide mechanism (not illustrated). The above-described unit-detection unit 70 ensures detecting this slide movement of the movable leg 60. The unit-detection unit 70 consequently ensures detecting the state change of the intermediate transfer unit 14 in association with the position change of the movable leg 60.

Such configuration causes the control unit (not illustrated) included in the apparatus main body 11 to execute an image forming operation when the intermediate transfer unit 14 is in the first state. On the other hand, when the intermediate transfer unit 14 is removed from the apparatus main body 11, the control unit preliminarily controls the driving mechanism G to change the intermediate transfer unit 14 into the second state from the first state. At this time, the unit-detection unit 70 detects the slide movement of the movable leg 60 to detect that the intermediate transfer unit 14 has changed into the second state (a state change). The primary transfer rollers 24 consequently move above to prevent the intermediate transfer unit 14 and the photoreceptor drum 20 from sliding strongly one another. This ensures detaching the intermediate transfer unit 14.

Additionally, in the embodiment, similarly to the above-described first embodiment, when the intermediate transfer unit 14 is mounted in the apparatus main body 11, the movable leg 60 becomes to have the first posture. Then, when the intermediate transfer unit 14 is inserted into the apparatus main body 11, the cleaning portion 604P of the movable leg 60 abuts on the light-emitting portion 701 of the unit-detection unit 70 to clean the light-emitting portion 701. Especially, in the embodiment, similarly to the first embodiment, the belt cleaning apparatus 144 is located at the proximity of the movable leg 60. Thus, if toner scattered slightly from the belt cleaning apparatus 144 is attached on the light-emitting portion 701, this causes instability of an irradiation of the detection light. In the embodiment, the light-emitting portion 701 is cleaned in association with the mounting and the detachment of the intermediate transfer unit 14. This causes the detection light to be stably emitted to maintain stable detection accuracy of the unit-detection unit 70. In another embodiment, the cleaning portion 604P may clean the light receiving portion 702. In the embodiment, the unit-detection unit 70 is included in the apparatus main body 11. This ensures cleaning the unit-detection unit 70 every time the intermediate transfer unit 14 is detached from the apparatus main body 11. Thus, a cost of the intermediate transfer unit 14 is preferably reduced.

Figure 16:
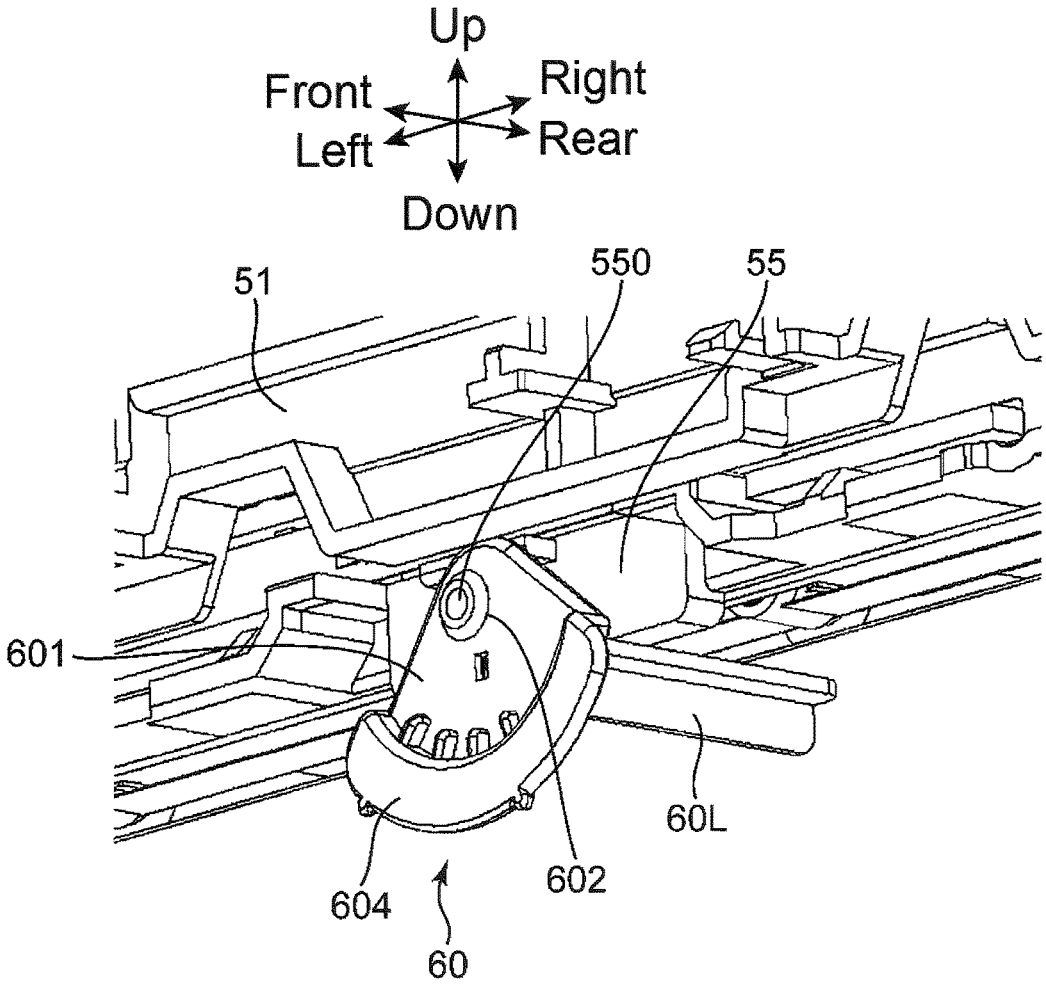
FIG. 16 obliquely illustrates a periphery of the movable leg of the intermediate transfer unit according to a fourth embodiment of the disclosure.
Figure 17:
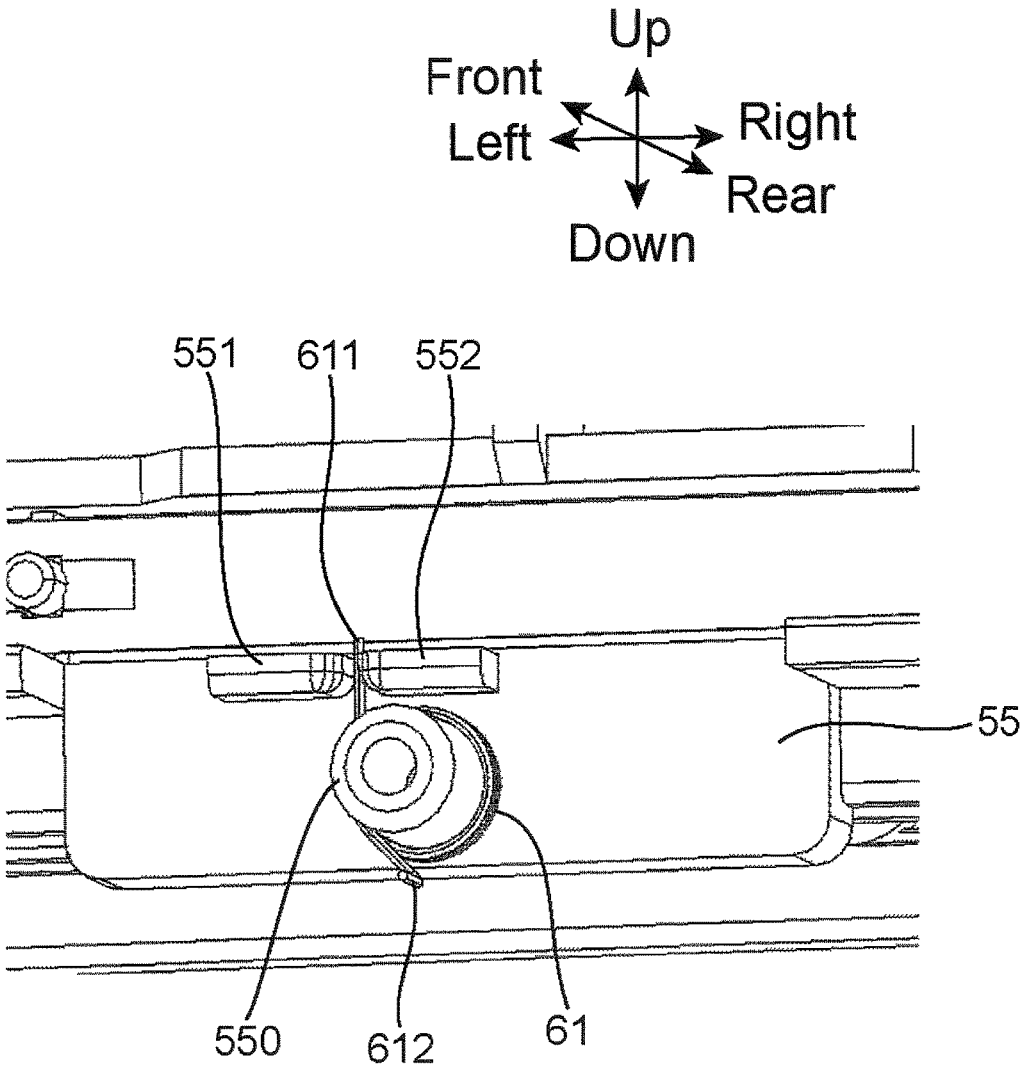
FIG. 17 obliquely illustrates the intermediate transfer unit according to the fourth embodiment in a state where the movable leg is removed.

Next, the following describes the movable leg 60 according to a fourth embodiment of the disclosure. FIG. 16 obliquely illustrates a periphery of the movable leg 60 of the intermediate transfer unit 14 according to the fourth embodiment. FIG. 17 obliquely illustrates the intermediate transfer unit 14 illustrated in FIG. 16 in a state where the movable leg 60 is removed. The fourth embodiment is different from the above-described first embodiment in that the movable leg 60 includes a belt supporting unit 60L. Thus, the following mainly describes differences between the first and fourth embodiments and omits descriptions of common points.

In the embodiment, the movable leg 60 is located at the center of the unit front wall 51 in the lateral direction. On the other hand, the unit rear wall 52 has both end portions in its lateral direction including a pair of leg portions (not illustrated). The unit front wall 51 includes a center plate portion 55. The center plate portion 55 is a plate-shaped portion facing the front at the lower end of the unit front wall 51. The center plate portion 55 includes a shaft portion 550. The hole portion 602 of the movable leg 60 is inserted into the shaft portion 550, causing the movable leg 60 to become turnable. Similarly to the above-described first embodiment, the center plate portion 55 includes a first engagement protrusion 551 and a second engagement protrusion 552 (see FIG. 17). The first spring end portion 611 of the bias spring 61 is locked between the first engagement protrusion 551 and the second engagement protrusion 552. On the other hand, the second spring end portion 612 of the bias spring 61 is locked by the movable leg 60.

In the embodiment, the movable leg 60 includes the belt supporting unit 60L. The belt supporting unit 60L is a bar-shaped projection piece protruding rearward from a rear side surface of the movable leg 60. As illustrated in FIG. 16, when the movable leg 60 becomes to have the first posture, the belt supporting unit 60L runs and extends in the front-rear direction below the center plate portion 55. The belt supporting unit 60L supports the lower surface portion of the intermediate transfer belt 141 from a lower side. Such configuration reduces damage of the downward-hung intermediate transfer belt 141 even when the intermediate transfer unit 14 detached from the apparatus main body 11 is directly placed on the floor surface.

While the above has described the intermediate transfer unit 14 according to respective embodiments of the disclosure and the image forming apparatus 10 including the same in detail, the disclosure is not limited to this. The disclosure can employ, for example, the following modified embodiments.

(1) While in the above-described first embodiment the intermediate transfer unit 14 includes the three leg portions constituted of the first fixed leg portion 51S, the second fixed leg portion 52S, and the movable leg 60, the disclosure is not limited to this. It is only necessary that the intermediate transfer unit 14 includes at least three or more leg portions. In this case, it is only necessary that the unit front wall 51 and the unit rear wall 52 each include at least one leg portion.

(2) While in the above-described first embodiment only the movable leg 60 is turnable among the three leg portions, the disclosure is not limited to this. The first fixed leg portion 51S and the second fixed leg portion 52S may be configured to be turnable similarly to the movable leg 60.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An intermediate transfer unit to be mounted into an apparatus main body including a plurality of photoreceptor drums, the plurality of the photoreceptor drums being rotationally driven about axes extending in a first direction, the plurality of the photoreceptor drums being located adjacent to one another at predetermined intervals in a second direction intersecting with the first direction, the intermediate transfer unit being mounted adjacent to the plurality of the photoreceptor drums along the second direction, the intermediate transfer unit comprising:

an intermediate transfer belt circularly driven along the second direction, the intermediate transfer belt having a surface that carries toner images transferred from the plurality of the photoreceptor drums;

a plurality of transfer rollers located opposed to the respective photoreceptor drums across the intermediate transfer belt;

a pair of sidewalls located extending in the second direction at both end sides of the first direction, the pair of the sidewalls supporting the intermediate transfer belt to be able to circulate; and;

a plurality of leg portions abutting on a predetermined installation surface when the intermediate transfer unit is detached from the apparatus main body, at least three of the leg portions being located at a lower end portion of the pair of the sidewalls, wherein at least one sidewall of the pair of the sidewalls includes a shaft portion protruding in the first direction, and at least one leg portion among the plurality of the leg portions is a movable leg turnable about the shaft portion, the movable leg having a changeable posture between a first posture and a second posture, the first posture being for supporting the intermediate transfer unit detached from the apparatus main body, the second posture being turned about the shaft portion from the first posture, the intermediate transfer unit further comprising a biasing member that biases the movable leg about the shaft portion to cause the movable leg to have the first posture.

2. The intermediate transfer unit according to claim 1, wherein the movable leg includes a plate-shaped member, the movable leg being arranged intersecting with the first direction and opposed to the one sidewall, the biasing member includes a twisted coil spring, the biasing member being located between the movable leg and the one sidewall, the biasing member being fitted onto the shaft portion, the movable leg includes a lock hole formed by passing through the movable leg along the first direction, the biasing member has one end portion locked at the one sidewall and another end portion locked in the lock hole, and the lock hole has a reverse taper shape reversely tapering toward the one sidewall.

3. An image forming apparatus, comprising:

the intermediate transfer unit according to claim 1;

the apparatus main body; and a plurality of image carriers that carry the toner images, the plurality of image carriers being located opposed to the intermediate transfer belt.

4. An intermediate transfer unit to be mounted into an apparatus main body including a plurality of photoreceptor drums, the plurality of the photoreceptor drums being rotationally driven about axes extending in a first direction, the plurality of the photoreceptor drums being located adjacent to one another at predetermined intervals in a second direction intersecting with the first direction, the intermediate transfer unit being mounted adjacent to the plurality of the photoreceptor drums along the second direction, the intermediate transfer unit comprising:

an intermediate transfer belt circularly driven along the second direction, the intermediate transfer belt having a surface that carries toner images transferred from the plurality of the photoreceptor drums;

a plurality of transfer rollers located opposed to the respective photoreceptor drums across the intermediate transfer belt;

a pair of sidewalls located extending in the second direction at both end sides of the first direction, the pair of the sidewalls supporting the intermediate transfer belt to be able to circulate; and;

a plurality of leg portions abutting on a predetermined installation surface when the intermediate transfer unit is detached from the apparatus main body, at least three of the leg portions being located at a lower end portion of the pair of the sidewalls, wherein at least one sidewall of the pair of the sidewalls includes a shaft portion protruding in the first direction, and at least one leg portion among the plurality of the leg portions is a movable leg turnable about the shaft portion, the movable leg having a changeable posture between a first posture and a second posture, the first posture being for supporting the intermediate transfer unit detached from the apparatus main body, the second posture being turned about the shaft portion from the first posture, wherein the movable leg includes:

a hole portion to be inserted into the shaft portion; and a main unit turnable about the shaft portion, wherein the main unit has an outer peripheral portion, the outer peripheral portion having a circular arc shape centered on the hole portion, the outer peripheral portion abutting on the installation surface when the intermediate transfer unit is detached from the apparatus main body, wherein the main unit includes a pair of protrusions protruding from the outer peripheral portion, the pair of the protrusions located at intervals in a circumferential direction of the circular arc shape, the pair of the protrusions located across the lowest end portion of the outer peripheral portion in the first posture.

5. The intermediate transfer unit according to claim 4, wherein the movable leg having the first posture includes the hole portion having an upper inner circumference surface and a lower inner circumference surface, the upper inner circumference surface being opposed to an upper end side of the shaft portion, the lower inner circumference surface being opposed to a lower end side of the shaft portion, and the intermediate transfer unit further includes a regulating mechanism that regulates a turn of the movable leg about the shaft portion when the movable leg having the first posture abuts on the installation surface.

6. The intermediate transfer unit according to claim 5, wherein the regulating mechanism includes a high-friction member located at the lower end side of the shaft portion, or at the lower inner circumference surface.

7. The intermediate transfer unit according to claim 5, wherein the regulating mechanism includes:

first gear teeth located at the lower end side of the shaft portion; and second gear teeth located at the lower inner circumference surface, the second gear teeth being engageable with the first gear teeth.

8. An intermediate transfer unit to be mounted into an apparatus main body including a plurality of photoreceptor drums, the plurality of the photoreceptor drums being rotationally driven about axes extending in a first direction, the plurality of the photoreceptor drums being located adjacent to one another at predetermined intervals in a second direction intersecting with the first direction, the intermediate transfer unit being mounted adjacent to the plurality of the photoreceptor drums along the second direction, the intermediate transfer unit comprising:

an intermediate transfer belt circularly driven along the second direction, the intermediate transfer belt having a surface that carries toner images transferred from the plurality of the photoreceptor drums;

a plurality of transfer rollers located opposed to the respective photoreceptor drums across the intermediate transfer belt;

a pair of sidewalls located extending in the second direction at both end sides of the first direction, the pair of the sidewalls supporting the intermediate transfer belt to be able to circulate and;

a plurality of leg portions abutting on a predetermined installation surface when the intermediate transfer unit is detached from the apparatus main body, at least three of the leg portions being located at a lower end portion of the pair of the sidewalls, wherein at least one sidewall of the pair of the sidewalls includes a shaft portion protruding in the first direction, and at least one leg portion among the plurality of the leg portions is a movable leg turnable about the shaft portion, the movable leg having a changeable posture between a first posture and a second posture, the first posture being for supporting the intermediate transfer unit detached from the apparatus main body, the second posture being turned about the shaft portion from the first posture, the intermediate transfer unit further comprising a belt supporting unit that supports the intermediate transfer belt from a lower side during the first posture, the belt supporting unit running and extending in the first direction from the movable leg.

* * * * *